US007592742B2

(12) United States Patent
Takahara et al.

(10) Patent No.: US 7,592,742 B2
(45) Date of Patent: Sep. 22, 2009

(54) FLUORESCENT LAMP, BULB-SHAPED FLUORESCENT LAMP, AND LIGHTING APPARATUS

(75) Inventors: Yuichiro Takahara, Yokosuka (JP); Masahiro Izumi, Fujisawa (JP); Nobuhiro Tamura, Yokosuka (JP); Mitsunori Nakamura, Yokosuka (JP); Toshiyuki Ikeda, Yokosuka (JP)

(73) Assignee: Toshiba Lighting & Technology Corporation, Shinagawa-Ku (JP)

( * ) Notice: Subject to any disclaimer, the term of this patent is extended or adjusted under 35 U.S.C. 154(b) by 363 days.

(21) Appl. No.: 11/206,419

(22) Filed: Aug. 16, 2005

(65) Prior Publication Data

US 2006/0006784 A1 Jan. 12, 2006

Related U.S. Application Data

(63) Continuation of application No. PCT/JP2004/000832, filed on Jan. 29, 2004.

(30) Foreign Application Priority Data

Feb. 17, 2003 (JP) ..... 2003-038746

(51) Int. Cl.
*H01J 1/62* (2006.01)
*H01J 63/04* (2006.01)

(52) U.S. Cl. ..... 313/490; 313/547; 313/550; 313/551; 313/552; 445/9; 445/38

(58) Field of Classification Search ..... 313/490, 313/547, 550–552; 445/9, 38
See application file for complete search history.

(56) References Cited

U.S. PATENT DOCUMENTS

| | | | | |
|---|---|---|---|---|
| 4,288,715 | A | 9/1981 | van Overveld et al. | |
| 5,204,584 | A | 4/1993 | Ikeda et al. | |
| 5,882,237 | A * | 3/1999 | Sarver et al. | 445/9 |

FOREIGN PATENT DOCUMENTS

| | | |
|---|---|---|
| JP | 62-113353 A | 5/1987 |
| JP | 7-19561 B | 3/1995 |
| JP | 2000-82440 | 3/2000 |
| JP | 2001-84956 | 3/2001 |
| JP | 2001-283773 | 10/2001 |
| JP | 2001-283774 | 10/2001 |

OTHER PUBLICATIONS

Oct. 26, 2006 Korean official action and English translation thereof.
International Search Report issued by the International Searching Authority issued May 11, 2004 in connection with related International Application No. PCT/JP2004/000832.

* cited by examiner

*Primary Examiner*—Nimeshkumar D. Patel
*Assistant Examiner*—Thomas A Hollweg
(74) *Attorney, Agent, or Firm*—John P. White; Cooper & Dunham LLP

(57) ABSTRACT

An auxiliary amalgam is contained in a light-emitting tube. The auxiliary amalgam has a base, a metal layer provided on the base, and a diffusion-inhibiting layer provided between the base and the metal layer.

3 Claims, 13 Drawing Sheets

13KV 3.00KX 3.33 μ

13KV 30.0KX 333n

13KV 3.00KX 3.33μ

13KV 30.0KX 333n

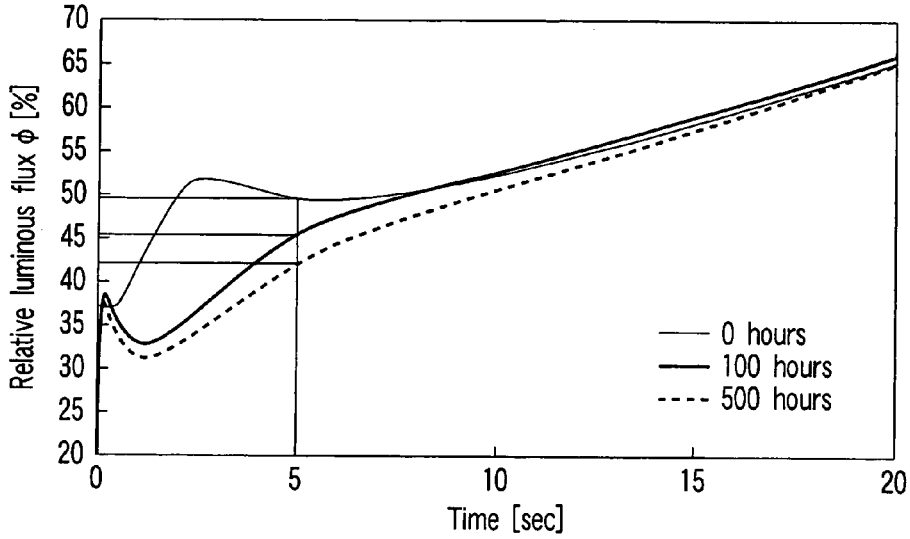
FIG. 18
| Total turning-on time (hrs) | Relative luminous flux (%) upon lapse of 5 sec from the turning-on | | | |
|---|---|---|---|---|
| | First embodiment | Second embodiment | Third embodiment | Comparative Example 2 |
| 0 | 56.6 | 53.3 | 51.7 | 49.8 |
| 100 | 52.4 | 51.1 | 53.9 | 45.9 |
| 500 | 54.0 | 51.8 | 50.9 | 42.6 |
FIG. 19
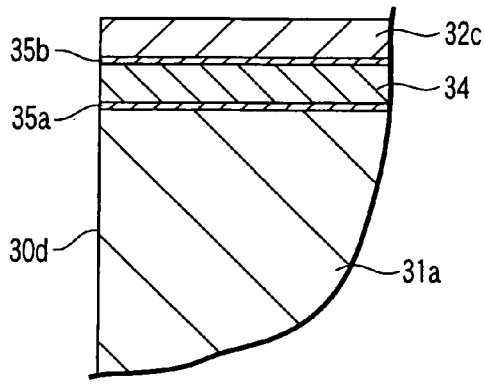
FIG. 20

FLUORESCENT LAMP, BULB-SHAPED FLUORESCENT LAMP, AND LIGHTING APPARATUS

CROSS-REFERENCE TO RELATED APPLICATIONS

This is a Continuation Application of PCT Application No. PCT/JP2004/000832, filed Jan. 29, 2004, which was published under PCT Article 21(2) in Japanese.

This application is based upon and claims the benefit of priority from prior Japanese Patent Application No. 2003-038746, filed Feb. 17, 2003, the entire contents of which are incorporated herein by reference.

BACKGROUND OF THE INVENTION

1. Field of the Invention

The present invention relates to a fluorescent lamp, a bulb-shaped fluorescent lamp, and a lighting apparatus having a fluorescent lamp or a bulb-shaped fluorescent lamp.

2. Description of the Related Art

In recent years, lighting apparatuses having a fluorescent lamp have become smaller, and their output has increased. In small and high-output lighting apparatuses, however, the light output of the fluorescent lamp tends to decrease. The smaller the lighting apparatus and the greater its output, the higher the temperature in the light-emitting tube of the fluorescent lamp becomes, with the result that the mercury-vapor pressure in the light-emitting tube is likely to increase. In order to suppress the excessive rise of the mercury-vapor pressure, fluorescent lamps for use in places where their intra-tube temperature may rise have a light-emitting tube filled with a main amalgam.

In the fluorescent lamp provided with the main amalgam, its light-emitting efficiency increases because the main amalgam suppresses an excessive rise of mercury-vapor pressure, as described above. However, a long time is required after a fluorescent lamp of this type is turned on, until the lamp starts emitting a predetermined luminous flux, i.e., the fluorescent exhibits a poor flux-startup characteristic. This is because the main amalgam suppresses the mercury-vapor pressure not only while the lamp is turned on, but also while the intra-tube temperature is as low as room temperature as occurring before the lamp is turned on, as compared to the fluorescent lamps filled with pure mercury. The fluorescent lamp having main amalgam emits a weak luminous flux immediately after it is turned on, due to the insufficient mercury-vapor pressure, though the luminous flux gradually increases as the intra-tube temperature rises, raising the mercury-vapor pressure in the sealed glass tube.

For these reasons, the fluorescent lamp having the main amalgam is provided with an auxiliary amalgam at a portion near the electrode, where the temperature can readily rise when the lamp is turned on. This adds a pressure to the mercury-vapor pressure in the light-emitting tube immediately after the lamp is turned on, thereby improving the flux-startup characteristics.

As auxiliary amalgam with which fluorescent lamps are provided, one is known that comprises a base made of stainless steel on which indium (In) is plated. However, this auxiliary amalgam is high in adsorption power for mercury, lowering the mercury-vapor pressure even more, while the lamp is turned off.

Further, as an auxiliary amalgam with which fluorescent lamps are provided, one is known which comprises a base on which gold (Au) is plated, as disclosed in Jpn. Pat. Appln. KOKAI Publication 2001-84956. Gold does not adsorb mercury excessively while the lamp remains off, and thus can maintain the mercury-vapor pressure relatively high at room temperature. It follows that a fluorescent lamp with auxiliary amalgam that comprises a base on which gold is plated can attain a large output immediately after it is turned on. Gold has a high melting point and hardly evaporates, and is hardly oxidized in the heating step during the manufacture of the fluorescent lamp. In view of this, gold is desirable for providing an auxiliary amalgam.

In the fluorescent lamp disclosed in Jpn. Pat. Appln. KOKAI Publication 2001-84956, however, the auxiliary amalgam has but a short lifetime. That is, the lamp obtains only a short period of time during which a flux-startup characteristic is improved. This is because gold is likely to diffuse into the base made of stainless steel (solid phase diffusion). Note that the gold layer plated on the stainless-steel base makes up for the mercury-vapor pressure in the fluorescent lamp immediately after the lamp is turned on. The gold therefore diffuses into the stainless-steel base. When the gold on the base decreases in amount, the auxiliary amalgam can no longer serve to provide a good flux-startup characteristic.

The technique described in Jpn. Pat. Appln. KOKAI Publication 2001-84956 may be employed to maintain a good flux-startup characteristic for a long time. In this case, the auxiliary amalgam must be plated with a thick gold layer. Gold is very expensive material. The thicker the gold layer, the higher the manufacturing cost of the fluorescent lamp.

BRIEF SUMMARY OF THE INVENTION

An object of the present invention is to provide a fluorescent lamp, a bulb-shaped fluorescent lamp, and a lighting apparatus, which exhibits good flux-startup characteristic for a long time.

In an aspect of this disclosure, a fluorescent lamp described in claim 1 comprises a light-emitting tube and an amalgam contained in the light-emitting tube. The amalgam has a base, a metal layer provided on the base, and a diffusion-inhibiting layer provided between the base and the metal layer to inhibit the diffusion of the metal from the metal layer into the base.

Unless otherwise specified, the definitions and technical meanings of the terms are as follows.

The light-emitting tube can be made of glass, or ceramic or the like that can form a light-transmitting sealed envelope. The glass may be lead glass, which has a low softening point and can easily be heat-processed, lead-free glass, which is environmentally friendly, or the like.

The light-emitting tube may be a straight one, an annular one and a bent one. Alternatively, it may comprise plurality of bent tubes connected together, end to end, with communicating tubes so as to form at least one electrical discharge path.

When the light-emitting tube has a bent tube, the bent tube can be U-shaped. The U-shaped, bent tube may be formed by heat melting the middle part of a straight tubular member (e.g., a straight glass tube) and then bending the tube at the middle part. Otherwise, it may be prepared by subjecting a straight tubular member to a molding process. The term "U-shaped, bent tube" means a tube having an electrical discharge path that is so folded that the discharge path is turned back. Therefore, the U-shaped, bent tube is not limited to one having a curved part or a circular part. Rather, it may be bent at an obtuse or acute angle. In other words, "U-shaped, bent tube" means a bulb consisting of straight tubular parts that are connected, end-to-end, so that the discharge circuit may be bent. The bent tube may be composed of two substantially parallel straight tubular parts that are connected by a connecting tube prepared by blown-off technique. Alternatively, the bent tube may be a spiral one.

The fluorescent lamp may be a general-type one that has a pair of electrodes respectively located at the ends of the discharge path provided in the light-emitting tube. Otherwise, the fluorescent lamp may be a so-called electrode-less lamp, which has no electrodes. If the fluorescent lamp has two electrodes located at the ends of the discharge path formed in the light-emitting tube, respectively, the electrodes may be hot cathodes made of filaments, ceramic electrodes coated with electron-emitting material, or cold cathode made of nickel or the like.

A phosphor layer is formed directly or indirectly on the inner surface of the light-emitting tube. The phosphor layer may be made of rare-earth-metal oxide phosphor, halophosphate phosphor, or the like. Nonetheless, the material of the phosphor layer is not limited to these. To enhance the light-emitting efficiency of the lamp, it is desirable to use three-wavelength emission phosphor that is a mixture of three phosphors that emits red light, blue light and green light, respectively.

The light-emitting tube is filled with a discharge medium. The discharge medium may be mercury, inert gas such as argon, neon, krypton or xenon, or a mixture gas of mercury and inert gas. The medium is not limited to these, nevertheless.

The amalgam contained in the light-emitting tube well serves as so-called "auxiliary amalgam." Auxiliary amalgam improves the flux-startup characteristic of the lamp. (It can shorten the time within which the luminous reaches a predetermined intensity after the lamp is turned on.) In addition to the auxiliary amalgam, so-called "main amalgam" is provided in the light-emitting tube, thereby filling mercury vapor in the tube. Note that the main amalgam provides an appropriate mercury-vapor pressure when the lamp is turned on.

The main amalgam may not be used at all. If this is the case, liquid mercury, a mercury pellet (Zn—Hg alloy), GEMEDIS (trade name, manufactured by Saes Getters, Inc.), or the like may be provided in the light-emitting tube, thereby filling the light-emitting tube with mercury. In this case, too, auxiliary amalgam can be used to improve the flux-startup characteristic of the fluorescent lamp.

Main amalgam, if provided in the light-emitting tube, is preferably one that can control the mercury-vapor pressure to an appropriate value when the lamp attains while operating in the stable state. The metal composition and mercury content of the main amalgam determine the mercury-vapor characteristic of the main amalgam. Metals desired as metal components of the main amalgam are bismuth (Bi), lead (Pb), Tin (Sn), indium (In), and the like. Thus, the main amalgam is, for example, bismuth (Bi)-Tin (Sn)-Mercury (Hg), bismuth (Bi)-Tin (Sn)-lead (Pb)-mercury (Hg), bismuth (Bi)-lead (Pb)-Indium (In)-mercury (Hg), or zinc (Zn)-mercury (Hg), or the like. Nonetheless, the main amalgam is not limited to these.

To make the auxiliary amalgam to perform it function appropriately, it is desirable to place it at a position where the temperature can easily raise, for example in the vicinity of the electrode. In a fluorescent lamp having an electrode, it is desired that the auxiliary amalgam be, for example, welded to the inner lead line that supports the electrode. In a fluorescent lamp comprising bent tubes connected together, the auxiliary amalgam may be positioned in one of the bent tube and at the midpoint of the discharge path. In an electrode-less lamp, the auxiliary amalgam should better be provided at a position in the discharge space, where the current density is high.

Iron (Fe), nickel (Ni), chromium (Cr), manganese (Mn), copper (Cu), niobium (Nb), molybdenum (Mo), zirconium (Zr), titanium (Ti), aluminum (Al), tungsten (W), carbon (C), or alloy containing at least two of these elements excels in heat resistance and is, therefore, suitable as the material of the base of the auxiliary amalgam.

Among the alloys containing at least two of the elements mentioned is stainless steel. The base made of stainless steel is very resistant to heat and easy to process, and is inexpensive. In view of these points, stainless steel is fit for the material of the base. Preferably, the base is shaped like a plate or a mesh. Otherwise, it may be shaped like a wire or a hollow cylinder. Nonetheless, the shape of the base is not limited to these.

It is desired that the metal layer of the auxiliary amalgam be made of metal that hardly adsorbs, to excess, the mercury in the light-emitting tube while the fluorescent lamp is operating. Therefore, the inventors hereof studied the metal layer of the auxiliary amalgam, in order to improve the flux-startup characteristic of the lamp.

First, the inventors prepared the following auxiliary amalgams. The base was made of stainless steel (i.e., alloy of Fe, Ni and Cr), and have a size of 2 mm×7 mm and a thickness of 40 μm. Then, a layer of different metal was formed on the base by means of electroplating.

Gold, silver, palladium, platinum, lead, tin, zinc and bismuth were used as materials of the metal layer. Different types of auxiliary amalgam, which have the same base as described above and layers of gold, silver, palladium, titanium, tin, zinc and bismuth, respectively, were used in bulb-shaped, 13 W-class fluorescent lamps that correspond to 60 W incandescent lamps.

On the other hand, a bulb-shaped fluorescent lamp provided with an auxiliary amalgam made of the abovementioned base on which indium was plated was prepared as Comparative Example 8; a bulb-shaped fluorescent lamp comprising no auxiliary amalgam was prepared as Comparative Example 9; and a bulb-shaped fluorescent lamp provided with an auxiliary amalgam made of abovementioned base on which nickel was plated was prepare as Comparative Example 10. These bulb-shaped fluorescent lamps were those of consumptive power of 13 W, corresponding to 60 W of incandescent lamp.

All bulb-shaped fluorescent lamps thus prepared were tested to determine the relation between the light-emitting time and relative light output.

As FIG. 27 shows, the bulb-shaped fluorescent lamps having a gold layer, a silver layer, a lead layer, a tin layer and a zinc layer, respectively, emitted light instantaneously when they were turned on, whose intensity was 30% to 40% of the intensity attained when the lamps operate in the stable state. The luminous flux well increased thereafter. Though not shown in FIG. 27, the bulb-shaped fluorescent lamps that had a palladium layer, a platinum layer and a bismuth layer, respectively, exhibited similar characteristics.

By contrast, the bulb-shaped fluorescent lamp according to Comparative Example 8 emitted light instantaneously when it was turned on, whose intensity was about 10% of the intensity attained when the lamp stably operated, though the luminous flux increased well. The bulb-shaped fluorescent lamp according to Comparative Example 9 emitted light whose intensity was about 40% instantaneously when it was turned on, but the luminous flux did not increased well thereafter. About three minutes had elapsed until it the light intensity increased to 80%. The bulb-shaped fluorescent lamp according to Comparative Example 10 exhibited characteristics similar to those of the lamp according to Comparative Example 9.

These characteristics can be explained as follows. In the bulb-shaped fluorescent lamp according to Comparative Example 9, which had no auxiliary amalgam, the mercury-vapor pressure in the light-emitting tube does not excessively falls while the lamp remains off. However, the liquid mercury existing near the discharge path that is the main heat-generating part is insufficient in amount. Inevitably, the luminous flux did not so increase as desired.

Nickel scarcely adsorbs mercury. Hence, what has been the of the Comparative Example 9 can hold true for the bulb-shaped fluorescent lamp according to Comparative Example 10 that uses nickel as material of the metal layer of the auxiliary amalgam.

Indium can adsorb a very large amount of mercury. Thus, in the bulb-shaped fluorescent lamp according to Comparative Example 8 that uses indium for the metal layer of the auxiliary amalgam, the mercury-vapor pressure in the light-emitting tube falls to excess while the lamp remains off. Consequently, the light the lamp emits instantaneously when turned on is not sufficiently intense.

Gold, silver, palladium, platinum, lead, tin, zinc and bismuth adsorb mercury not so little as nickel and no so much as indium. Hence, the bulb-shaped fluorescent lamp that contains auxiliary amalgam having a metal layer of gold, silver, palladium, platinum, lead, tin, zinc or bismuth can emit intense light from the start, and the luminous flux increases well.

The above mentioned fluorescent lamps, which will further be described later, should better have a metal layer that contains at least one element selected from the group consisting of gold (Au), silver (Ag), palladium (Pd), platinum (Pt), lead (Pb), tin (Sn), zinc (Zn) and bismuth (Bi).

Preferably, the metal layer consists mainly of one element selected from the group consisting of gold, silver, palladium, platinum, lead, tin, zinc and bismuth, or the metal layer consists mainly of alloy that contains at least two elements selected from the group consisting of gold, silver, palladium, platinum, lead, tin, zinc and bismuth.

The clause "the metal layer consists mainly of one element selected from the group consisting of gold, silver, palladium, platinum, lead, tin, zinc and bismuth" means a metal layer that contains at least 50% by mass of one of gold, silver, palladium, platinum, lead, tin, zinc and bismuth. That is, the metal layer may of course be made of substantially only gold, silver, palladium, platinum, lead, tin, zinc or bismuth. Alternatively, the metal layer may be made of a mixture (alloy) that contains at least 50% by mass of one element selected from the group consisting of gold, silver, palladium, platinum, lead, tin, zinc and bismuth. The phrase "substantially only" means that the metal layer may contain a trace of impurities. More preferably, the metal layer contains at least 90% by mass of any one element selected from the group consisting of gold, silver, palladium, platinum, lead, tin, zinc and bismuth.

The clause "the metal layer consists mainly of alloy that contains at least two elements selected from the group consisting of gold, silver, palladium, platinum, lead, tin, zinc and bismuth" means that the metal layer contains at least 50% by mass of alloy of at least two elements selected from the group consisting of gold, silver, palladium, platinum, lead, tin, zinc and bismuth. That is, the metal layer may contain any elements other than those specified, provided that at least two elements selected from the group consisting of gold, silver, palladium, platinum, lead, tin, zinc and bismuth account for at least 50% by mass of the metal layer. Preferably, the metal layer contains at least 90% by mass of alloy of at least two elements selected from the group consisting of gold, silver, palladium, platinum, lead, tin, zinc and bismuth.

The metal layer may be one that contains not only gold, silver, palladium, platinum, lead, tin, zinc and bismuth but also a small amount (about 0.1 to 8% by mass) of nickel (Ni), copper (Cu), cobalt (Co), iron (Fe) or the like. Alternatively, the metal layer may be one that consists mainly of gold or silver and contains a small amount (about 0.1 to 8% by mass) of nickel, cobalt, platinum, palladium, copper, iron and the like. Particularly, any alloy prepared by adding nickel and cobalt in small amount to gold is called "hard gold," which is harder than pure gold. A metal layer made of this alloy is desirable, because it is hardly worn or peeled off during the manufacture of the fluorescent lamp. The metal layer can be provided on the base by means of electroplating or vapor deposition.

The metal layer that contains at least one element selected from the group consisting of gold (Au), silver (Ag), palladium (Pd), platinum (Pt), lead (Pb), tin (Sn), zinc (Zn) and bismuth (Bi) may have compositions exemplified below. Nevertheless, the metal layer is not limited to these examples.

(a) Pb: 50% by mass; Bi: 50% by mass
(b) Au: 92% by mass; Ag: 8% by mass
(c) Au: 75% by mass; Ag: 25% by mass
(d) Au: 10% by mass; Ag: 90% by mass
(e) Au: 98% by mass; Ag: 1% by mass; Ni, Co, Pt, Pd, Cu and Fe: 1% by mass
(f) Au: 92% by mass; Ag: 7% by mass; Ni, Co, Pt, Pd, Cu and Fe: 1% by mass
(g) Au: 70% by weight; Ag: 29% by mass; Ni, Co, Pt, Pd, Cu and Fe: 1% by mass
(h) Au: 70% by weight; Ag: 23% by mass; Ni, Co, Pt, Pd, Cu and Fe: 7% by mass
(i) Au: 40% by mass; Ag: 59% by mass; Ni, Co, Pt, Pd, Cu and Fe: 1% by mass
(j) Au: 40% by mass; Ag: 53% by mass; Ni, Co, Pt, Pd, Cu and Fe: 7% by mass
(k) Bi: 60% by mass; Pb: 20% by mass; Sn: 10% by mass; Cu: 9% by mass; Ni, Co, Pt, Pd and Fe: 15% by mass
(l) Au: 70% by mass; Ag: 20% by mass; Cu: 9% by mass; Ni, Co, Pt, Pd and Fe: 1% by mass
(m) Au: 70% by mass; Ag: 20% by mass; Bi: 9% by mass; Ni, Co, Pt, Pd, Cu and Fe: 1% by mass
(n) Au: 70% by mass; Ag: 20% by mass; Pb: 9% by mass; Ni, Co, Pt, P-d, Cu and Fe: 1% by mass
(o) Au: 70% by mass; Ag: 20% by mass; Sn: 9% by mass; Ni, Co, Pt, Pd, Cu and Fe: 1% by mass Preferably, the diffusion-inhibiting layer is made of material into which metal particles hardly diffuse from the metal layer. In the above-mentioned lamp, it is therefore desired that the diffusion-inhibiting layer should contain at least one element selected from the group consisting of nickel (Ni), chromium (Cr), molybdenum (Mo) and tungsten (W).

Gold, silver, palladium, platinum, lead, tin, zinc bismuth and the like are, among others, hardly diffuse into the elements (chromium, molybdenum and tungsten) belonging to Group VI of the Periodic Table and nickel. Hence, metal particles will scarcely diffuse (solid phase diffusion) from the metal layer into the base if a diffusion-inhibiting layer containing one or more of nickel, chromium, molybdenum and tungsten is interposed between the base and the metal layer. This can lengthen the lifetime of the amalgam.

It is more desired that the diffusion-inhibiting layer be made mainly of least one element selected from the group consisting of nickel, chromium, molybdenum and tungsten, or be made mainly of alloy containing at least two elements selected from the group consisting of nickel, chromium, molybdenum and tungsten.

The clause "the diffusion-inhibiting layer be made mainly of one element selected from the group consisting of nickel, chromium, molybdenum and tungsten" means a diffusion-inhibiting layer that contains at least 50% by mass of at least one element selected from the group consisting of nickel, chromium, molybdenum and tungsten. That is, the diffusion-inhibiting layer may of course be made of substantially only nickel, chromium, molybdenum or tungsten. Alternatively, the diffusion-inhibiting layer may be made of a mixture (alloy) that contains at least 50% by mass of one element selected from the group consisting of nickel, chromium, molybdenum and tungsten. The phrase "substantially only" means that the diffusion-inhibiting layer may contain a trace of impurities. More preferably, the diffusion-inhibiting layer contains at least 90% by mass of any one element selected from the group consisting of nickel, chromium, molybdenum and tungsten.

The phrase "made mainly of alloy containing at least two elements selected from the group consisting of nickel, chromium, molybdenum and tungsten" means a diffusion-inhibiting layer containing at least 50% by mass of alloy that contains at least two elements selected from the group consisting of nickel, chromium, molybdenum and tungsten. Namely, the diffusion-inhibiting layer may be made of a mixture (alloy) that contains not only at least two elements selected from the group consisting of nickel, chromium, molybdenum and tungsten, but also other elements, if the at least two elements account for at least 50% by mass. More preferably, the diffusion-inhibiting layer contains at least 90% by mass of at least two elements selected from the group consisting of nickel, chromium, molybdenum and tungsten.

The following simple method can demonstrate that the metal layer of the auxiliary amalgam hardly gets thinner.

First, two types of auxiliary amalgams are prepared. One type comprises a base (e.g., one made of stainless steel) and a metal layer (e.g., gold layer) formed on the base hand having thickness of about 0.5 μm. The other type comprises a base (e.g., one made of stainless steel), a diffusion-inhibiting layer (e.g., nickel layer) formed on the base hand having thickness of about 0.5 μm, and a metal layer (e.g., gold layer) formed on the diffusion-inhibiting layer and having thickness of about 0.5 μm. The auxiliary amalgams, thus prepared, are heated at about 500° C. in a vacuum furnace for about 1 hour. Then, the amalgam having no diffusion-inhibiting layer loses the luster of gold and reveals the luster of stainless steel, whereas the amalgam having a diffusion-inhibiting layer keeps presenting the luster of gold. This simple method shows that metal hardly diffuses from the metal layer into the base, owning to the diffusion-inhibiting layer interposed between the base and the metal layer.

To make the lamp retain good the flux-startup characteristic for a long time, it is desired that the diffusion-inhibiting layer of the amalgam should have a thickness of 0.01 μm or more and 5 μm or less. The diffusion-inhibiting layer must be 0.01 μm or more thick, because some metal particles in the metal layer diffuse into the diffusion-inhibiting layer, too. If the thickness of the diffusion-inhibiting layer is less than 0.01 μm, metal particles (crystals of metal) will diffuse from the metal layer into the diffusion-inhibiting layer, soon reaching the base. If the thickness of the diffusion-inhibiting layer is less than 0.01 μm, it will have pinholes, through which metal particles may pass into the base. In order to reduce the material cost, to decrease the amount of amalgam required and to improve the process efficiency, it is desired that the diffusion-inhibiting layer be about 5 μm or less thick, preferably about 0.03 to 2 μm thick.

After formed on the diffusion-inhibiting layer that is provided on the base, the metal layer may be hardly provided on the diffusion-inhibiting layer (that is, the metal layer may not be laid on the diffusion-inhibiting layer). If this is the case, a peeling-inhibiting layer made mainly of nickel should better be provided between the base and the metal layer, more precisely between the diffusion-inhibiting layer and the metal layer. The diffusion-inhibiting layer may not be firmly provided on the base (that is, the diffusion-inhibiting layer may not be firmly laid on the base). In this case, too, it is desirable to provide a peeling-inhibiting layer made mainly of nickel, between the base and the metal layer, more precisely between the base and the diffusion-inhibiting layer.

The phrase "peeling-inhibiting layer made mainly of nickel" means a peeling-inhibiting layer that contains at least 50% by mass of nickel. Preferably, the peeling-inhibiting layer contains at least 90% by mass of nickel.

In the above-mentioned fluorescent lamps, a diffusion-inhibiting layer is provided between the metal layer and the base to inhibit metal from diffusing into the base from the metal layer. Thus, metal particles (crystals of metal) in the metal layer can hardly diffuse into the diffusion-inhibiting layer or the base. This lengthens the lifetime of the amalgam (i.e., the period for which the flux-startup characteristic remains good thanks to the amalgam). Moreover, the metal layer can be thinner than in the conventional lamp because metal particles scarcely diffuse from the metal layer into the base. The material cost of the metal layer can therefore decrease.

Nickel, chromium, molybdenum and tungsten are more expensive than stainless steel. Hence, any amalgam that has a diffusion-inhibiting layer containing at least one element selected from the group consisting of nickel, chromium, molybdenum and tungsten and being interposed between the metal layer and the base made of stainless steel can be manufactured at a lower cost than the amalgam whose base contains at least one element selected from the group consisting of nickel, chromium, molybdenum and tungsten. Such amalgam is used in the above-mentioned fluorescent lamp.

The above-mentioned fluorescent lamp is advantageous in that the material cost of amalgam is low and in that the weight of amalgam is small. In addition, the diffusion-inhibiting layer can easily formed on the base, without having pinholes.

In the above-mentioned fluorescent lamp, the metal layer is inhibited from peeling from the base, and the diffusion-inhibiting layer and the metal layer can be easily formed, one upon the other.

The above-mentioned fluorescent lamp comprises a light-emitting tube and amalgam contained in the light-emitting tube. The amalgam has a base and a metal layer. The base contains at least one element selected from the group consisting of chromium, molybdenum and tungsten. The metal layer contains at least one element selected from the group consisting of gold, silver, palladium, platinum, lead, tin, zinc and bismuth and is provided on the base.

Preferably, the metal layer be made of metal would not excessively adsorb mercury in the light-emitting tube while the fluorescent lamp remains off. Hence, it is desired that the metal layer contain at least one element selected from the group consisting of gold, silver, palladium, platinum, lead, tin, zinc and bismuth.

More preferably, the metal layer is made mainly of at least one element selected from the group consisting of gold, silver, palladium, platinum, lead, tin, zinc and bismuth, or made mainly of alloy that contains at least two elements selected from the group consisting of gold, silver, palladium, platinum, lead, tin, zinc and bismuth. The phrase "the metal layer is made mainly of at least one element selected from the group consisting of gold, silver, palladium, platinum, lead, tin, zinc and bismuth," and the phrase "made mainly of alloy that contains at least two elements selected from the group consisting of gold, silver, palladium, platinum, lead, tin, zinc and bismuth" of the same meaning as described above.

As pointed out already, gold, silver, palladium, platinum, lead, tin, zinc bismuth, and the like are, among others, hardly diffuse into the elements of Group VI (chromium, molybdenum and tungsten) in the periodic table. Therefore, metal particles will scarcely diffuse from the metal layer into the base if the base is made of material that contains at least one element selected from the group consisting of chromium, molybdenum and tungsten. This can lengthen the lifetime of the amalgam.

It is more desirable that the base be made mainly of one element selected from the group consisting of chromium, molybdenum and tungsten, or made mainly of alloy that contains at least two elements selected from the group consisting of chromium, molybdenum and tungsten.

The clause "the base made mainly of one element selected from the group consisting of chromium, molybdenum and tungsten" means a base that contains at least 50% by mass of at least one element selected from the group consisting of chromium, molybdenum and tungsten. Namely, the base may of course be made of substantially only chromium, molybdenum or tungsten. Alternatively, the base may be made of a mixture (alloy) that contains at least 50% by mass of one element selected from the group consisting of chromium, molybdenum and tungsten. The phrase "substantially only" means that the metal layer may contain a trace of impurities. The phrase "substantially only" means that the metal layer may contain a trace of impurities. Preferably, the base contains at least 90% by mass of any one element selected from the group consisting of chromium, molybdenum and tungsten.

The clause "the base made mainly of alloy that contains at least two elements selected from the group consisting of chromium, molybdenum and tungsten" means a base that contains at least 50% by mass of alloy containing at least two elements selected from the group consisting of chromium, molybdenum and tungsten. Namely, the base may be made of a mixture (alloy) that contains other elements, if the at least two elements account for at least 50% by mass. Preferably, the base contains at least 90% by mass of at least two elements selected from the group consisting of nickel, chromium, molybdenum and tungsten.

The base may be made mainly of molybdenum. That is, the base may of course be made of molybdenum only. Alternatively, the base may be made of molybdenum doped with yttrium (Y).

The metal layer may likely to peel off (that is, the metal layer may not be firmly adhered to the base). If this is the case, it is desirable to provide a peeling-inhibiting layer made mainly of nickel, between the base and the metal layer. The phrase "peeling-inhibiting layer made mainly of nickel" is of the same meaning as specified above.

In the above-mentioned fluorescent lamp, metal particles hardly diffuse from the metal layer into the base even if the metal layer is made mainly one element selected from the group consisting of gold, silver, palladium, platinum, lead, tin, zinc, lead and bismuth. This is because the base contains at least one element selected from the group consisting of chromium, molybdenum and tungsten. Hence, it is possible to lengthen the lifetime of the amalgam (i.e., the period for which the flux-startup characteristic remains good thanks to the amalgam). Moreover, the metal layer can be thinner than in the conventional lamp because metal particles scarcely diffuse from the metal layer into the base. The material cost of the metal layer can therefore decrease.

The above-mentioned fluorescent lamp comprises a light-emitting tube and amalgam contained in the light-emitting tube. The amalgam has a base and a metal layer provided on the base. The crystals that constitute the metal layer are porous.

The clause "The crystals that constitute the metal layer are porous" means such a state as is illustrated in FIGS. 8 and 9.

Such a metal layer can be formed by electroplating the base with metal that forms a layer on the base if the potential between the electrodes is lower than usual and is raised upon lapse of a predetermined time.

The speed with which the crystals grow does not depend on the potential between the electrodes. Nonetheless, the higher the potential, the faster the nuclei of crystal grow. Hence, if the potential between the electrodes is lower than usual, the crystals grow faster than the nuclei. As a result, the crystallization is promoted. The potential between the electrodes is raised after the crystals have grown to some extent. Then, the speed with which the nuclei grow increases, and the ion concentration falls at the surface of the cathode. When the ion concentration falls at the surface of the cathode, discharging can hardly be achieved at the entire surface. Only partial discharging occurs, making the surface gradually uneven. Eventually, the surface has projections and depressions. The ion concentration at the projections is higher at any other regions. Discharging is concentrated at the projections. The growth of crystal is therefore promoted at the projections and thereabout. As a result, crystals are deposited, forming such a porous layer as shown in FIGS. 8 and 9. This type of deposition is called "dendrite deposition." If the ordinary deposition, not dendrite deposition, takes place, such crystals as shown in FIGS. 10 and 11 will be formed.

Preferably, the metal layer is one to which mercury in the light-emitting tube scarcely is excessively adsorbed during turning-off of the fluorescent lamp. In view of this, it is desired that the metal layer contain at least one element selected from the group consisting of gold, silver, palladium, platinum, lead, tin, zinc and bismuth.

More preferably, the metal layer is made mainly of one element selected from the group consisting of gold, silver, palladium, platinum, lead, tin, zinc and bismuth, or made mainly of alloy containing at least two elements selected from the group consisting of gold, silver, palladium, platinum, lead, tin, zinc and bismuth. The clause "the metal layer is made mainly of one element selected from the group consisting of gold, silver, palladium, platinum, lead, tin, zinc and bismuth," and the phrase "made mainly of alloy containing at least two elements selected from the group consisting of gold, silver, palladium, platinum, lead, tin, zinc and bismuth" are of the same meaning as mentioned above.

The metal layer may not be provided on the base (that is, the metal layer may not be laid on the base). In this case, it is desirable to provide a peeling-inhibiting layer made mainly of nickel, between the base and the metal layer. The phrase "peeling-inhibiting layer made mainly of nickel" is of the same meaning as specified above.

In the above-mentioned fluorescent lamp, it is desired that the crystals that form the metal layer be used at a filling ratio of 10% to 90% as defined in claim 7.

The term "filling ratio" is the ratio of the volume that the metal particles actually occupy to the apparent volume that the metal layer has.

Assume that a layer of gold (Au) having an area S [$cm^2$] and a thickness of t [cm] is formed on a flat substrate. The apparent volume of the layer is S×t. Gold has specific density d of 19.32 [g/cm$^3$]. If the filling ratio is 100%, gold will stick to the substrate in an amount of d×S×t [g]. In the porous metal layer shown in FIGS. 8 and 9, spaces exits between the crystals. Thus, gold sticks to the substrate in an amount that is smaller than d×S×t [g]. The porous metal layer shown in FIGS. 8 and 9 (formed by dendrite deposition) has a filling ratio of about 80%. By contrast, such a metal layer as shown in FIGS. 10 and 11 (formed through the ordinary deposition) has a filling ratio of about 100%.

If the metal has a filling ratio of less than 10%, the metal layer will likely peel from the base. If the metal layer has a filling ratio exceeding 90%, the area at which the metal particles contact the base will be so large that the metal particles can easily diffuse into the base.

In the above-mentioned fluorescent lamp, the area at which the metal particles (crystals of the metal) contact the base can be reduced. Thus, the metal particles hardly diffuse into the base. This can lengthen the lifetime of the amalgam (i.e., the period for which the flux-startup characteristic remains good thanks to the amalgam). In addition, the metal layer can be thinner than is possible hitherto, because the metal particles hardly diffuse into the base. This helps to decrease the material cost of the metal layer.

The above-mentioned fluorescent lamp comprises a light-emitting tube, and amalgam contained in the tube and having a base and a metal layer provided on the base. The crystals that constitute the metal layer have a size that satisfies at least one of the following three conditions. First, randomly selected regions of the surface of the metal layer have an arithmetic mean roughness that exceeds 0.02 μm. Second, these regions of the surface of the metal layer have a maximum roughness-height that exceeds 0.3 μm. Third, the surface of the metal layer has a ten-point average roughness that exceeds 0.2 μm.

In the above-mentioned fluorescent lamp, the crystals that constitute the metal layer have a size that satisfies at least one of the following three conditions. First, randomly selected regions of the surface of the metal layer have an arithmetic mean roughness that exceeds 0.02 μm. Second, these regions of the surface of the metal layer have a maximum height roughness that exceeds 0.3 μm. Third, the surface of the metal layer has a ten-point average roughness that exceeds 0.2 μm.

The arithmetic mean roughness Ra, the maximum roughness-height Ry, and the ten-point average roughness Rz are defined at JIS B 0601, Japanese Industrial Standards. They are parameters, each indicating the surface roughness of some parts, selected at random, of a metal layer to be examined. Generally, an object has no uniform surface roughness; the surface roughness differs, from one region to another. Therefore, the metal layer need not have a uniform surface roughness, only if it meets at least one of the above-mentioned three conditions, i.e., arithmetic mean roughness Ra>0.02 μm, maximum roughness-height Ry of roughness>0.3 μm, and ten-point average roughness Rz>0.2 μm.

For the above-mentioned fluorescent lamp, the size of the crystals in the metal layer (i.e., crystals constituting the metal layer) is defined in terms of the surface roughness that the metal layer has. This is because the surface of the metal layer becomes rougher as the crystals in the metal layer grow larger.

A metal layer of this type can be formed by electroplating the base with metal, by maintaining a relatively low potential between the electrodes for a predetermined time and then raising the potential upon lapse of the predetermined time, as in forming the metal layer of the amalgam which the fluorescent lamp has. The metal layer thus formed comprises crystals that are shaped like needles or grains, and therefore has a surface more rough than ordinary gloss plating.

It is desired that the metal layer be made of metal hardly adsorbs mercury in the light-emitting tube while the fluorescent lamp remains off. Thus, in the above-mentioned fluorescent lamp too, the metal layer should better contain at least one element selected from the group consisting of gold, silver, palladium, platinum, lead, tin, zinc and bismuth, as in the fluorescent lamp.

More preferably, the metal layer is made mainly of one element selected from the group consisting of gold, silver, palladium, platinum, lead, tin, zinc and bismuth, or made mainly of alloy that contains at least two elements selected from the group consisting of gold, silver, palladium, platinum, lead, tin, zinc and bismuth. The clause "the metal layer is made mainly of one element selected from the group consisting of gold, silver, palladium, platinum, lead, tin, zinc and bismuth" and the phrase "made mainly of alloy that contains at least two elements selected from the group consisting of gold, silver, palladium, platinum, lead, tin, zinc and bismuth" are of the same meaning as specified above.

The metal layer may hardly be provided on the base (that is, the metal layer may not be laid on the base). In this case, it is desirable to provide a peeling-inhibiting layer made mainly of nickel, between the base and the metal layer, as in the fluorescent lamp. The phrase "peeling-inhibiting layer made mainly of nickel" is of the same meaning as specified above.

In the above-mentioned fluorescent lamp, the metal crystals in the metal layer satisfy at least one of the following three conditions. The first condition is that randomly selected regions of the surface of the metal layer have an arithmetic mean roughness Ra that exceeds 0.02 μm. The second condition is that the metal layer has a maximum roughness-height Ry that exceeds 0.3 μm. The third condition is that the surface of the metal layer has a ten-point average roughness that exceeds 0.2 μm. Hence, the crystals hardly diffuse from the metal layer into the base. This lengthens the lifetime of the amalgam (i.e., the period for which the flux-startup characteristic remains good thanks to the amalgam). Further, the metal layer can be thinner than is possible hitherto, because the crystals hardly diffuse from the metal layer into the base. This helps to decrease the material cost of the metal layer.

The above-mentioned fluorescent lamp can include a metal layer having a thickness of 0.05 μm to 5 μm.

The thinner the metal layer, the better the flux-startup characteristic. It was found that lamps exhibit good flux-startup characteristic if they have amalgam having a metal layer that is 5 μm or less thick. It was found that the lamps maintain good flux-startup characteristic to the end of their lifetime, even if the metal diffuses a little into the base, if the metal layer has a thickness of 0.05 μm or more.

To enhance the flux-startup characteristic, to reduce the material cost and to decrease the amount of amalgam required, it is desired that the metal layer be as thin as possible. If the metal layer is too thin, however, it will be difficult to form and process it. Hence, it is preferred that the metal layer be about 0.5 μm thick in order to enhance the flux-startup characteristic, to reduce the material cost and to decrease the amount of amalgam required, as well as to improve processability of the metal layer.

In the above-mentioned fluorescent lamp, the metal layer is 0.05 μm to 5 μm thick. This suppresses the material cost and the amount of amalgam used. Moreover, the lamp can maintain good flux-startup characteristic to the end of its lifetime.

In the above-mentioned lamp, the base is 10 μm to 60 μm thick.

To reduce the material cost and decrease the amount of amalgam used, it is desired that the base be 60 μm or less thick. To be sufficiently strong and heat-resistant, the base should be 10 μm or more thick. Preferably, the base is about 40 μm±10 μm.

In the fluorescent lamp, wherein the base is 10 μm to 60 μm thick, the amalgam can be sufficiently strong and heat-resistant. In addition, the material cost can be reduced and the amalgam can be used in a reduced amount. Moreover, the base can be easily processed. In the fluorescent lamp, the amalgam can release mercury upon receiving heat generated immediately after the lamp is turned on.

In this lamp, a peeling-inhibiting layer made mainly of nickel is provided between the base and the metal layer.

The phrase "made mainly of nickel" is of the same meaning as described above. To reduce the material cost, decrease the amount of amalgam required and prevent the metal layer from coming off the base during. the manufacture of the lamp, the peeling-inhibiting layer should be 5 μm or less think, preferably about 0.01 μm thick.

Generally, metal can be well laid on the outer surface, which is made mainly of nickel. That is, since the metal layer can be easily laid on the above-mentioned outer surface and the metal layer hardly peels from it, by providing a peeling-inhibiting layer made mainly of nickel between the metal layer and the base or between the metal layer and the diffusion-inhibiting layer, the metal layer can be stably provided on the outer surface of the base through the peeling-inhibiting layer. This make it possible to prevent the peeling of the metal layer during the manufacturing of the fluorescent lamp, and the lamp can maintain improved flux-startup characteristic for a long time.

The above-mentioned lamp further comprises main amalgam that produces a mercury-vapor pressure of 0.04 Pa or more at 25° C.

To improve the flux-startup characteristic even more, the mercury-vapor pressure should be high while the lamp remains off. It is therefore desirable that the main amalgam should bring forth a mercury-vapor pressure of 0.04 Pa or more at 25° C. The mercury-vapor pressure that pure mercury generates at 25° C. is about 0.24 Pa. Hence, the mercury-vapor pressure at 25° C. would not exceed 0.24 Pa. More preferably, the main amalgam should produce a mercury-vapor pressure 0.15 Pa or more at 25° C. and of 1.0 Pa to 2.0 Pa at 50° C. to 70° C. As a main amalgam having such characteristics, for example, one prepared by adding 4 to 25% by mass of mercury to an alloy having 50 to 60% by mass of bismuth (Bi) and 35 to 50% by mass of tin (Sn) may be mentioned. Nevertheless, the main amalgam is not limited to this one.

Since the above-mentioned fluorescent lamp comprises main amalgam that brings forth a mercury-vapor pressure of 0.04 Pa or more at 25° C., the fluorescent lamp can have its flux-startup characteristic improved even more. Further, the mercury-vapor pressure in the light-emitting tube can be controlled to an appropriate value while the lamp is operating in the stable state.

The bulb-shaped fluorescent lamp comprises a fluorescent lamp of the type described herein, a lamp-driving device, and a cover. The lamp-driving device has a substrate and electronic components mounted on the substrate, and is configured to output high-frequency power to the fluorescent lamp. The cover contains the lamp-driving device, and has a cap at one end and a holding part at the other end. The holding part holds the fluorescent lamp.

Since the bulb-shaped fluorescent lamp comprises a fluorescent lamp of the type described herein, the bulb-shaped fluorescent lamp can maintain a good flux-startup characteristic for a long time. Additionally, it can be manufactured at a lower cost than the conventional bulb-shaped fluorescent lamps.

A lighting apparatus hereinafter comprises a fluorescent lamp and a main unit to which the fluorescent lamp is attached. The fluorescent lamp is of the type described herein.

Another lighting apparatus hereinafter comprises a bulb-shaped fluorescent lamp and a main unit to which the fluorescent lamp is attached. The bulb-shaped fluorescent lamp is of the type described herein.

The main unit can be a known-type one, such as a bulb-burying unit or a direct-holding unit designed for, for example, down lights. Alternatively, the main unit may be the main unit of a light apparatus already installed. The above-mentioned lighting apparatus may have a small main unit or a large-output, lamp-driving device. In this case, they operate well if the temperature can easily be raised in the light-emitting tube of the fluorescent lamp.

The above-mentioned lighting apparatus preferably has a fluorescent lamp that can maintain a good flux-startup characteristic for a long time.

The above-mentioned lighting apparatus can have a bulb-shaped fluorescent lamp that can maintain a good flux-startup characteristic for a long time.

BRIEF DESCRIPTION OF THE SEVERAL VIEWS OF THE DRAWING

FIG. 15 is a diagram representing the flux-startup characteristic that a fluorescent lamp having the first auxiliary amalgam exhibits immediately after it is turned on;

FIG. 16 is a diagram representing the flux-startup characteristic that a fluorescent lamp having the second auxiliary amalgam exhibits immediately after it is turned on;

FIG. 17 is a diagram representing the flux-startup characteristic that a fluorescent lamp having the third auxiliary amalgam exhibits immediately after it is turned on;

FIG. 18 is a diagram illustrating the flux-startup characteristic that the fluorescent lamp according to Comparative Example 2 exhibits immediately after it is turned on;

FIG. 19 is a table showing the relative luminous fluxes that three fluorescent lamps having the first, second and third auxiliary amalgam, respectively, emit five seconds after they are turned on, and showing the relative luminous flux that the fluorescent lamp of Comparative Example 2 emits five seconds after it is turned on;

FIG. 20 is a magnified sectional view of a part of the fourth auxiliary amalgam used, in place of the first auxiliary amalgam, in the fluorescent lamp according to the first embodiment;

DETAILED DESCRIPTION OF THE INVENTION

The first embodiment of this invention will be described, with reference to FIGS. 1 to 12. This embodiment is applied to a fluorescent lamp and a bulb-shaped fluorescent lamp that comprises this fluorescent lamp.

Figure 1:
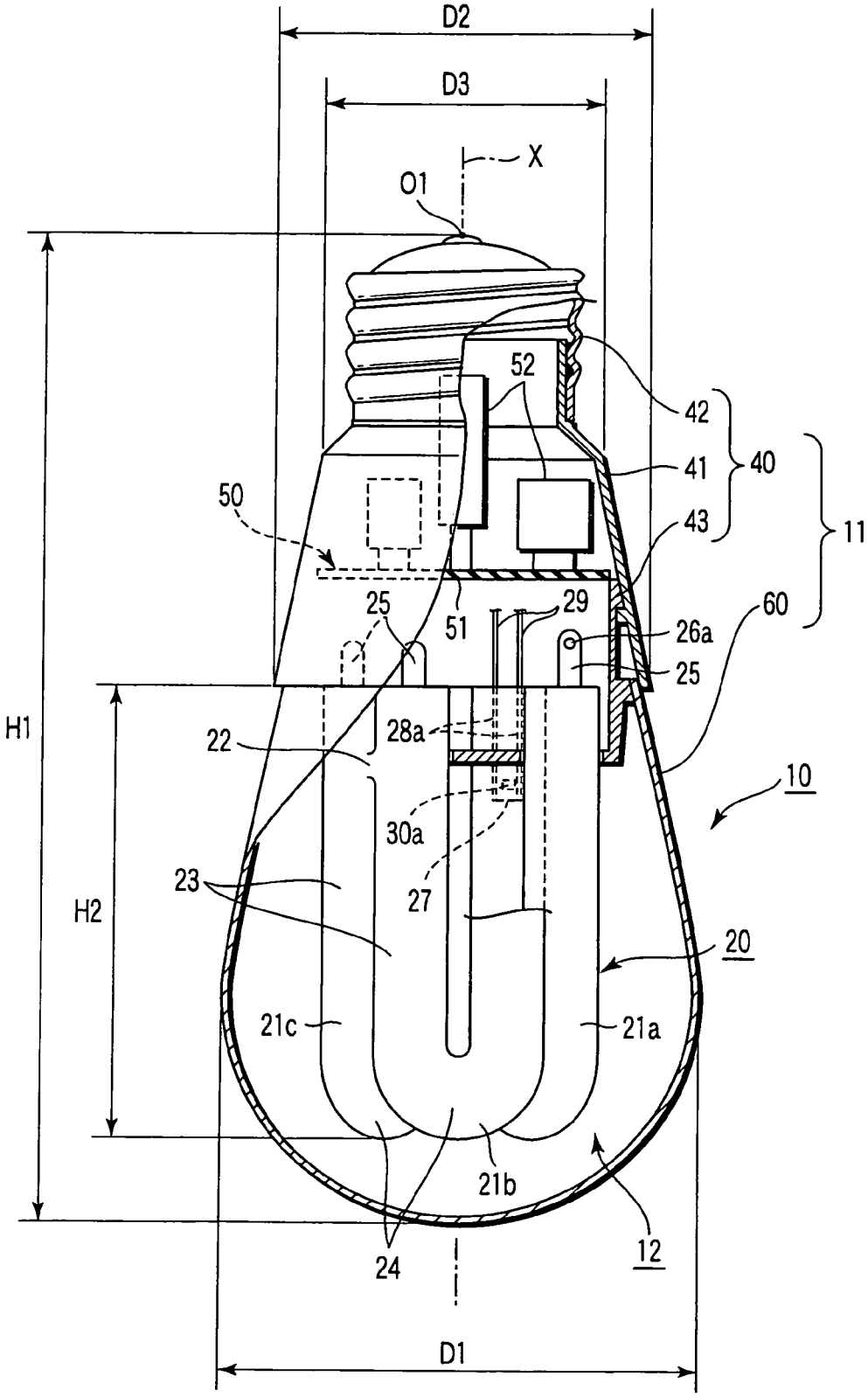
FIG. 1 is a partly sectional side view showing a bulb-shaped fluorescent lamp that comprises a fluorescent lamp according to a first embodiment of this invention.

As FIG. 1 shows, the bulb-shaped fluorescent lamp 10 comprises a fluorescent lamp 12, a cover 40, a lamp-driving device 50, and a globe 60. The cover 40 comprises a cover body 41, a cap 42, and a holder 43. The cap 42 is provided at one end of the cover body 41. The holder 43 is provided at the other end of the cover body 41 and used as a holding part.

The cover 40 and the globe 60 constitute an envelope 11. The envelope 11 is formed, having a size similar to the standard size of bulbs for general lighting use, such as incandescent lamps that have the rated power of 40 W. The fluorescent lamp 10 has height H1 of about 110 to 125 mm, including that of the cap 42, and diameter D1 of about 50 to 60 mm, which is the diameter of the globe 60. The cover 40 has diameter D2 of about 40 mm. The phrase "bulbs for general lighting use" means the bulbs defined at JIS C 7501. The envelope 11 contains the fluorescent lamp 12 and the lamp-driving device 50.

The fluorescent lamp 12 comprises a light-emitting tube 20, main amalgam 26*a*, and auxiliary amalgam 30*a*. The light-emitting tube 20 has an alumina ($Al_2O_3$) protection film (not shown) and a phosphor layer (not shown). The protection film is formed on inner surface of the tube 20. The phosphor layer is formed on the protection film and made of three-wave emitting phosphor, or a mixture of three phosphors that emit, for example, red light, blue light and green light, respectively. The red-emitting phosphor is, for example, europium-activated yttrium oxide phosphor ($Y_2O_2:Eu^{3+}$), which has peak wavelength of about 610 nm. The blue-emitting phosphor is, for example, europium-activated barium aluminate-magnesium phosphor ($BaMg_2Al_{16}O_{27}:Eu^{3+}$), which has peak wavelength of about 450 nm. The green-emitting phosphor is, for example, cerium and tellurium-activated lanthanum phosphate light-emitting substance ($(La, Ce, Tb)PO_4$), which has peak wavelength of about 540 nm. The three-wave emitting phosphor may be adjusted to emit light of desired chromaticity by mixing not only the red-, blue- and green-emitting phosphors specified above, but also a phosphor that emits light of a color other than the red, blue and green. The phosphor layer is provided in the light-emitting tube 20 by means of coating, after bent tubes 21*a*, 21*b* and 21*c* are prepared as will be described later.

Figure 2:
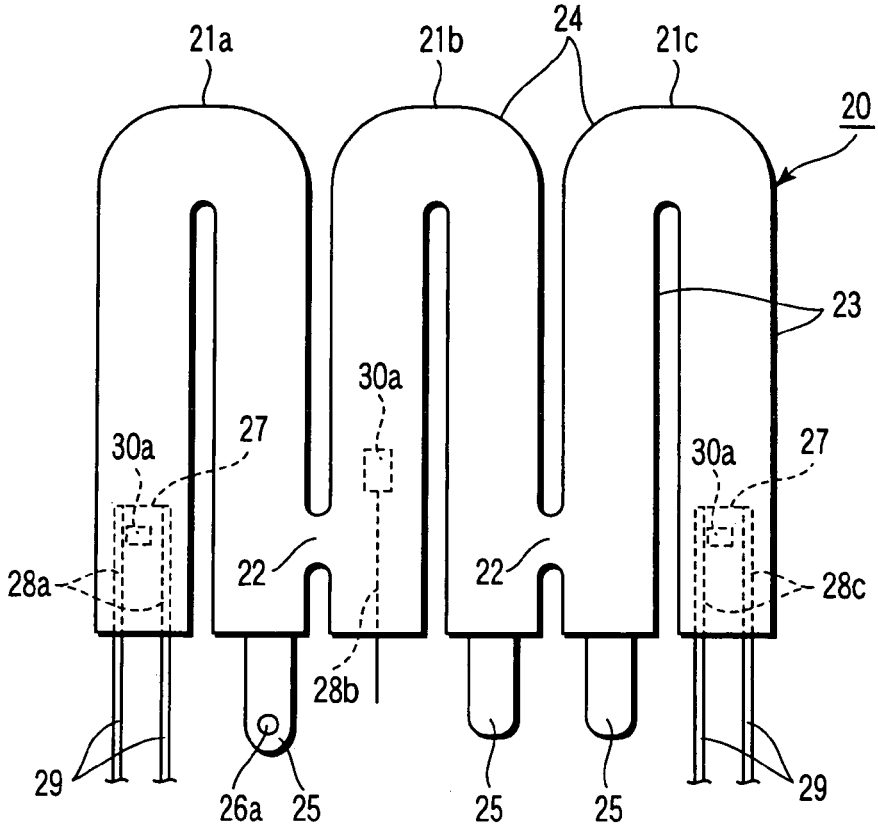
FIG. 2 is an expansion plan view of the light-emitting tube provided in the fluorescent lamp according to the first embodiment.
Figure 3:
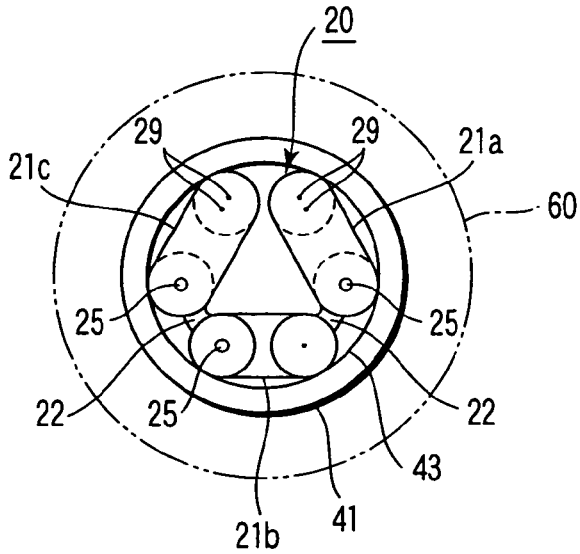
FIG. 3 is a plan view showing the light-emitting tube of the fluorescent lamp according to the first embodiment, as viewed from the cap, while the tube being held by a holder.

As FIG. 2 shows, the light-emitting tube 20 comprises a plurality of bent tubes that are substantially identical in shape. For example, the tube 20 comprises three bent tubes 21*a*, 21*b* and 21*c*. The bent tubes 21*a*, 21*b* and 21*c* are arranged at prescribed positions and coupled, one to the next one, by connecting tubes 22. Thus, coupled, the bent tubes constitute one discharge path. The three bent tubes 21*a*, 21*b* and 21*c* are U-shaped. Each bent tube has a pair of straight tubes 23 and a curved part 24. The straight tubes 23 are substantially parallel. The curved part 24 connects the straight tubes 23, end to end. As FIG. 3 depicts, the bent tubes 21*a*, 21*b* and 21*c* are so arranged that the straight tubes 23 lie on a circle and that three curved parts 24 define a triangle. Thus, the bent tubes form a triple-U structure. The light-emitting tube 20 may comprise four bent tubes. In this case, the curved portions of the bent tubes define a square.

The bent tubes 21*a*, 21*b* and 21*c* are made of lead-free glass. Each bent tube has an outside diameter of about 11 mm and an inside diameter of about 9.4 mm, and a wall thickness of about 0.8 mm. It has been formed by smoothly bending the middle part of a straight tube about 110 to 130 mm long. The curved part 24 of each bent tube can be formed into a desired shape by heating and bending the middle part of a straight tube, then inserting the bent part in a mold, and finally pressurizing the inside of the bent part. Thus, the curved part 24 can have any desired shape that complies with the shape of the mold.

Preferably, the bent tubes 21*a*, 21*b* and 21*c* have an outside diameter of 9.0 to 13.0 mm and a wall thickness of 0.5 to 1.5 mm. It is desired that the length of discharge path in the light-emitting tube 20 should be 250 to 500 mm and a lamp-input power is 8 to 25 W.

That is, the light-emitting tube 20 comprising, as bent tubes 21*a*, 21*b* and 21*c*, glass tubes having an outside diameter of 9.0 to 13.0 mm and a wall thickness of 0.5 to 1.5 mm can constitute the bulb-shaped fluorescent lamp 10 having a shape similar to that of incandescent lamps, if designed to have a discharge path of 250 to 500 mm long and a lamp-input power of 8 to 25 W. The inventors hereof conducted a study to find a turning-on region in which the lamp efficiency of the light-emitting tube 20 can be improved if the discharge path is lengthened. The study shows that the lamp efficiency can be remarkably improved if the discharge path is 250 to 500 mm long and if the lamp-input power ranges from 8 W to 25 W.

The bent tubes 21*a*, 21*b* and 21*c* are liable to deform due to the heating during the manufacture of the fluorescent lamp 10 or to the temperature difference between the turned-off period and the turned-on period. The mechanical strength of the connecting tubes 22 decreases, greatly depending on the outside diameter and wall thickness of the glass tubes used as connecting tubes 22. If the bent tubes 21*a*, 21*b* and 21*c* have an outside diameter less than 9.0 mm or a wall thickness less than 0.5 mm, the light-emitting tube 20 will likely be broken, due to a cause other than the deformation of the bent tubes 21*a*, 21*b* and 21*c*. Therefore, it is not desired that the bend tubes 21*a*, 21*b* and 31*c* have an outside diameter less than 9.0 mm or a wall thickness less than 0.5 mm. If the bent tubes 21*a*, 21*b* and 21*c* have an outside diameter exceeding 13 mm, or a wall thickness exceeding 1.5 mm, the connecting tubes 22 will acquire sufficient mechanical strength.

The glass used as material of the bent tubes 21*a*, 21*b* and 21*c* contains a large amount of sodium component ($Na_2O$), i.e., alkali component. The e sodium component deposits at the heating step in forming the bent tubes 21*a*, 21*b* and 21*c*. It reacts with the phosphor, possibly degrading the phosphor. In view of this, it is desired that the bent tubes 21*a*, 21*b* and 21*c* be made of material that contains essentially no lead and contains a limited amount of the sodium component. If made of such material, the bent tubes will little influence the environment and scarcely degrade the phosphor. Hence, the fluorescent lamp 12 can have its flux-startup characteristic improved.

The glass used as material of the bent tubes 21*a*, 21*b* and 21*c* has a specific composition. The glass is composed of, in weight ratio, 60 to 75% of $SiO_2$, 1 to 5% of $Al_2O_3$, 1 to 5% of $Li_2O$, 5 to 10% of $Na_2O$, 1 to 10% of $K_2O$, 0.5 to 5% of CaO, 0.5 to 5% of MgO, 0.5 to 5% of SrO, and 0.5 to 7% of BaO. In the glass, $SrO/BaO \geqq 1.5$, and $MgO+BaO \leqq SrO$. Made of the glass having this composition, the bent tubes 21*a*, 21*b* and 21*c* more improved the flux-startup characteristic of the light emitting tube 20 than bent tubes made of leaded glass, though it remains unclear why.

The bent tubes 21*a*, 21*b* and 21*c* are sealed, each at one end by pinch sealing or the like. The bent tubes are connected at the other end to thin pipes 25, by pinch sealing or the like. The thin pipes 25 have an outside diameter of 2 to 5 mm and an inside diameter of 1.2 to 4.2 mm. They protrude from one end of the light-emitting tube 20. The thin pipe 25 on the bent tube 21*b* located in the middle is a dummy pipe. The thin pipe 25 on the bent tube 21*c* located at one side serves to evacuate the light-emitting tube 20. The thin pipe 25 on the bent tube 21*a* located on the other side contains the main amalgam 26*a*.

The main amalgam 26*a* comprises, for example, a base made of 50 to 60% by mass of bismuth (Bi) and 35 to 50% by mass of tin (Sn), to which 12 to 25% by mass of mercury is added.

A filament coil 27 used as an electrode is sealed and supported by a pair of wells 28*c* in that end part of the bent tube 21*c* (located at one end of the light-emitting tube 20), which is coupled to no other bent tube. Similarly, a filament coil 27 used as an electrode is sealed and supported by a pair of wells 28*a* in that end part of the bent tube 21*a* (located at the other end of the light-emitting tube 20), which is coupled to no other bent tube. The wells 28*a* and 28*c* are connected to four wire 29 extending from the light-emitting tube 20, by Dumet wire (not shown) sealed by means of pinch sealing without a mount, or the like. Two pairs of wires, or four wires 29, are electrically connected to the lamp-driving device 50.

A plurality of auxiliary amalgam masses, for example three auxiliary amalgam masses 30*a*, are provided in the vicinity of the filament coils 27. More correctly, one of the three auxiliary amalgam masses 30*a* is attached to one of the wells 28*a* provided in the bent tube 21*a*. Another of the three auxiliary amalgam mass 30*a* is attached to one of the wells 28*c* provided in the bent tube 21*c*. The remaining auxiliary amalgam mass 30*a* is provided in the middle bent tube 21*b*. This auxiliary amalgam mass 30*a* is attached to a well 28*b* sealed by pinch sealing or the like and is located in the discharge path.

Figure 4:
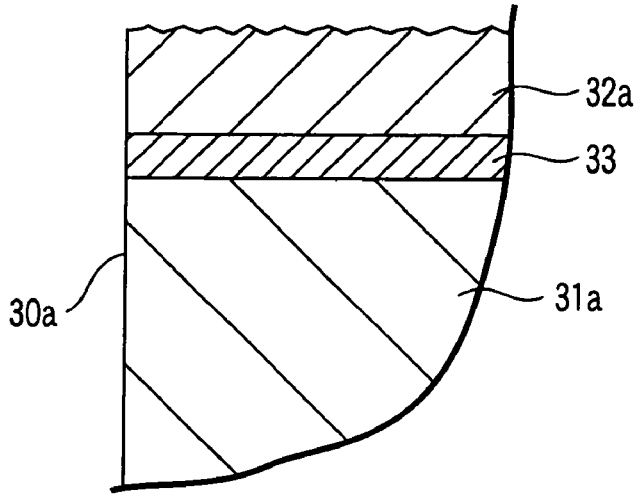
FIG. 4 is a partly magnified sectional view depicting the first auxiliary amalgam provided in the fluorescent lamp according to the first embodiment.

As FIG. 4 shows, each auxiliary amalgam 30*a* has a base 31*a*, a nickel layer 33 and a metal layer 32*a*. More precisely, a nickel layer 33 made mainly of nickel is formed on the base 31*a*, to a thickness of about 0.5 μm. The metal layer 32*a* is made of substantially only gold (Au) and formed on the nickel layer 33.

The base 31*a* is a plate of stainless steel (iron-nickel-chromium alloy), which is, for example, 2 mm wide, 7 mm long and 40 μm thick. The nickel layer 33 functions as a peeling-inhibiting layer that inhibits the metal layer 32*a* from peeling from the base 31*a*. The layer 33 functions as diffusion-inhibiting layer, too, which inhibits metal from diffusing from the layer 32*a* into the base 31*a*. The nickel layer 33 is provided on the base 31*a* by means of, for example, electroplating.

To be more specific, the metal layer 32*a* comprises at least 98% by mass of gold and contains, as impurities, nickel, cobalt and the like. The mean thickness of the metal layer 32*a* is 1.0 μm. The metal layer 32*a* is formed on the nickel layer 33, through dendrite deposition of substantially pure gold, which is accomplished, for example, by a plating method using an alkaline bath. Some surface regions of the metal layer 32*a*, selected at random, were removed and examined for surface roughness. These surface regions had arithmetic mean roughness Ra of 0.047 μm, maximum roughness-height Ry of 0.762 μm, and ten-point average roughness Rz of 0.538 μm.

Figure 8:
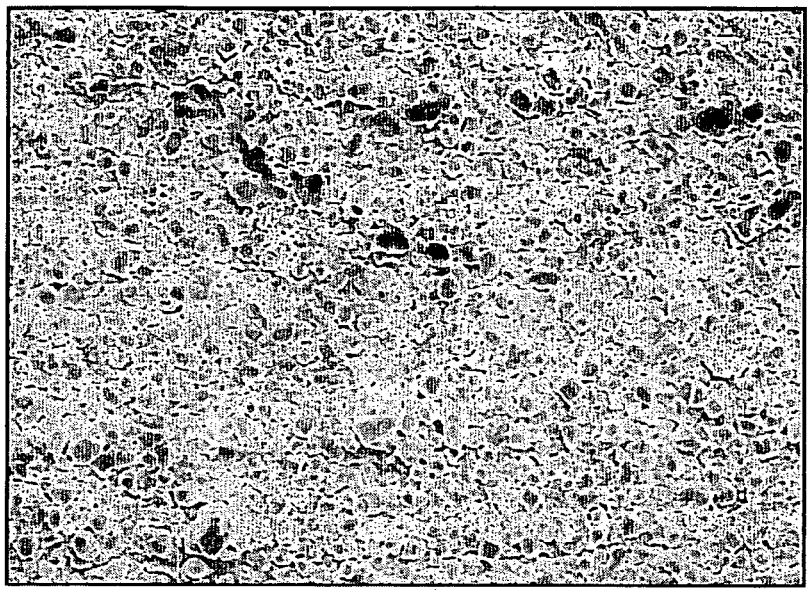
FIG. 8 is a photograph of the metal layer of the auxiliary amalgam shown in FIG. 4, magnified 3,000 times.
Figure 9:
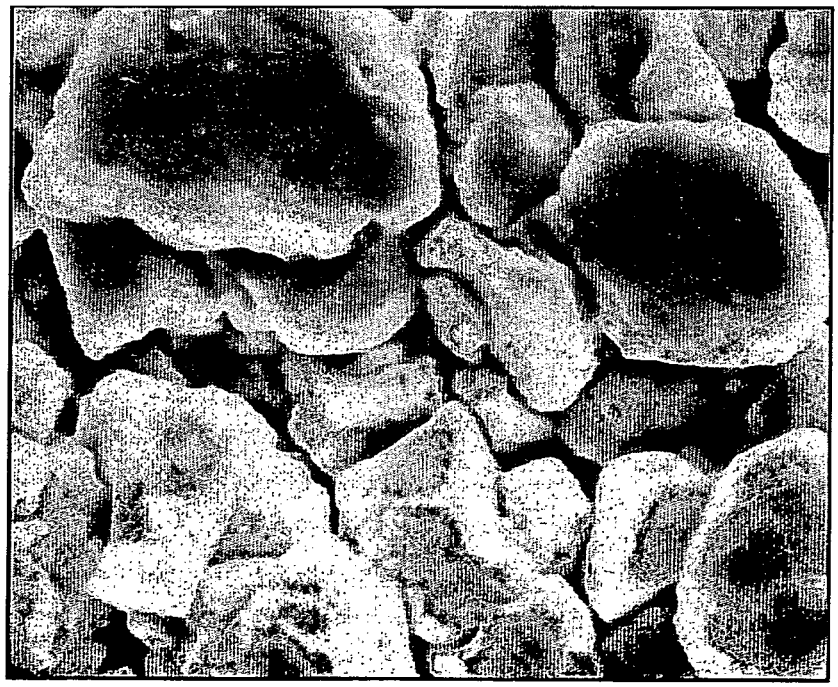
FIG. 9 is a photograph of the metal layer of the auxiliary amalgam shown in FIG. 4, magnified 10,000 times.
Figure 10:
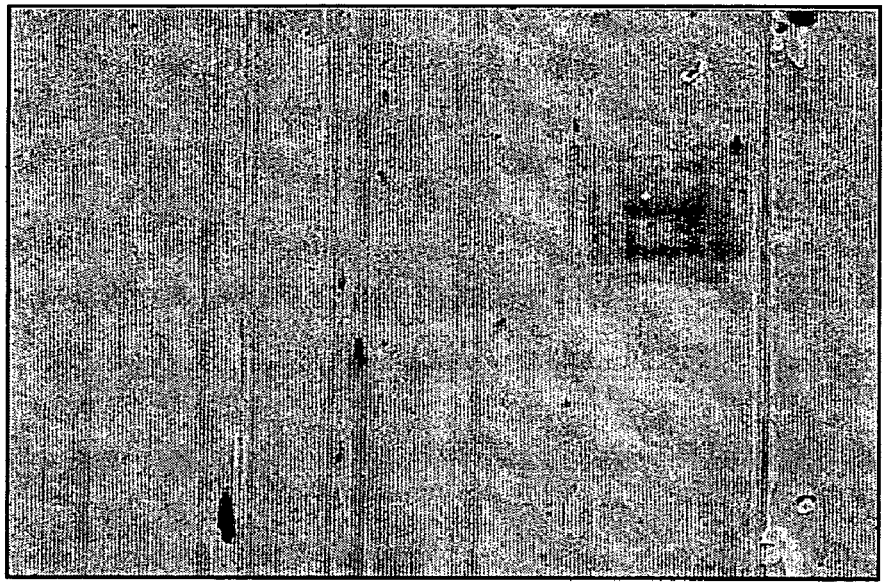
FIG. 10 is a photograph of a conventional metal layer formed by electroplating, magnified 3,000 times.
Figure 11:
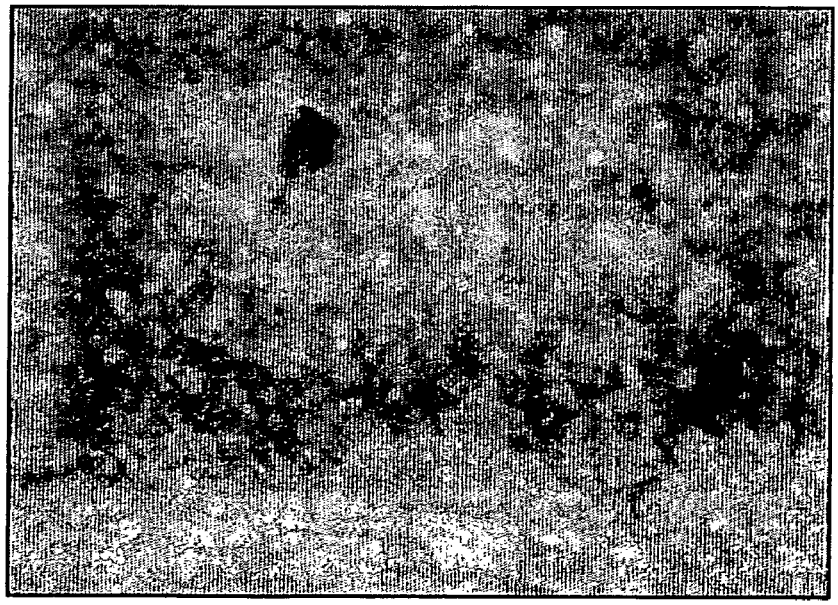
FIG. 11 is a photograph of the conventional metal layer formed by electroplating, magnified 10,000 times.

FIGS. 8 and 9 show a central surface part of the metal layer 32*a*, photographed at different magnifications. As seen from FIGS. 8 and 9, the crystals constituting the metal layer 32*a* are porous. The crystals have grown larger than those that form the conventional plated metal layer (see FIGS. 10 and 11). The crystals forming the metal layer 32*a* exist at a filling ratio of about 80%.

Figure 5:
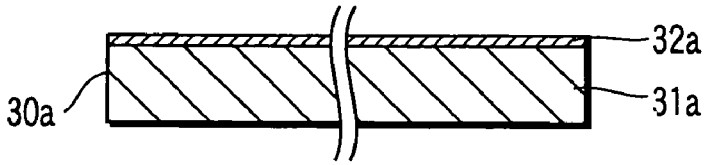
FIG. 5 is a sectional view showing the first auxiliary amalgam provided in the fluorescent lamp according to the first embodiment.
Figure 6:
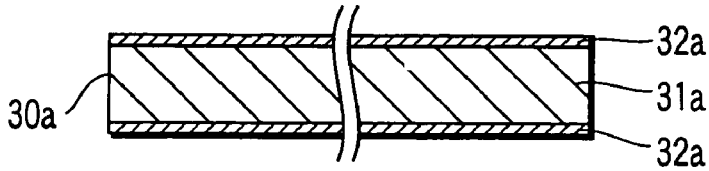
FIG. 6 is a sectional view showing another type of auxiliary amalgam that may be provided in the fluorescent lamp according to the first embodiment.
Figure 7:
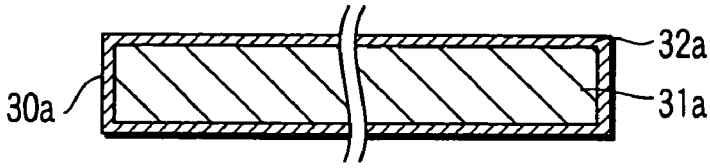
FIG. 7 is a sectional view showing still another type of auxiliary amalgam that may be provided in the fluorescent lamp according to the first embodiment.

The metal layer 32*a* may be provided on only one surface of the base 31*a*, as illustrated in FIG. 5. Alternatively, it may be formed on both surfaces of the base 31*a*, as depicted in FIG. 6. Otherwise, it may cover all surfaces of the base 31*a*, as shown in FIG. 7. The auxiliary amalgam 30*a* may be prepared by forming a metal layer 32*a* on a stainless-steel strip of the prescribed size (about 2 mm×about 7 mm, in this embodiment). Instead, it may be made by first forming a metal layer 32*a* on a large stainless-steel plate and then cutting the plate into pieces of a prescribed size (about 2 mm×about 7 mm, in this embodiment).

As is known in the art, the metal layer easily absorbs hydrogen if formed by electroplating. The reason why so is thought to be as follows.

Electroplating is a process of forming a metal layer on a base that acts cathode, by virtue of electrolysis that proceeds in a bath of the aqueous solution containing a specific substance. To form a gold (Au) layer on a stainless-steel base, for example, an aqueous solution containing gold cyanide or the like is used, and the stainless-steel base is used as cathode. As a result, a gold layer is formed on the stainless-steel base.

In electroplating, side reactions usually accompanies the main reaction, i.e., the electrolysis of the substance. More precisely, the side reactions are the oxidation of water (generation of oxygen at the anode) and the reduction of water (generation of hydrogen at the cathode). Both chemical reactions (i.e., oxidation and reduction) take place in the aqueous solution. The hydrogen generated at the cathode is easily absorbed into the metal layer that is being formed by electroplating.

Electroplating using an acidic bath is believed to generate more hydrogen in the side reaction than electroplating that uses a neutral bath or an alkaline bath.

In any electroplating using a neutral or alkaline bath, hydrogen is generated in a side reaction, as the electrolysis of water proceeds as indicated by the following formula (1):

$$2H_2O+2e \rightarrow 2OH^- + H_2\uparrow \quad (1)$$

Any acidic bath contains more hydrogen ions ($H^+$) than the neutral or alkaline bath. Hence, in electroplating using an acidic bath, a side reaction of the following formula (2) accompanies the main reaction, i.e., the electrolysis of water, indicated by the formula (2)

$$2H^+ + 2e \rightarrow H_2\uparrow \quad (2)$$

This is why any metal layer formed by electroplating using an acidic bath is believed to absorb more hydrogen than any metal layer formed by electroplating using a neutral or alkaline bath.

When hydrogen gas mingles into the discharge medium filled in the light-emitting tube of a fluorescent lamp, it may raise the starting voltage, decrease the ultraviolet-ray output or degrade the characteristic of the fluorescent lamp. It is therefore desirable to inhibit hydrogen from entering the light-emitting tube as much as possible. When the auxiliary amalgam prepared by applying electroplating is inserted into the light-emitting tube, however, hydrogen inevitably enters the light-emitting tube together with the auxiliary amalgam. The hydrogen absorbed in the metal layer of the auxiliary amalgam gradually emanates into the light-emitting tube as the amalgam is heated while the fluorescent lamp remains on or as the metal layer undergoes sputtering due to electric discharge.

It is therefore desired that the auxiliary amalgam should absorb hydrogen as little as possible. Hydrogen may be removed from the auxiliary amalgam by heating the auxiliary amalgam. In view of this, auxiliary amalgam from which hydrogen can be removed at low temperatures is preferable.

The amount of hydrogen that the auxiliary amalgam 30*a* has absorbed was measured. Also measured was the amount of hydrogen absorbed into auxiliary amalgam according to Comparative Example 1, which will be described below.

As described above, the auxiliary amalgam 30*a* comprises a base 31*a*, a nickel layer 33 formed on the base 31*a*, and a metal layer 32*a* made of dendrite Au formed on the nickel layer 33 by dendrite electroplating. The metal layer 32*a* was prepared by electroplating using an alkaline bath as described above. Some surface region of the metal layer 32*a*, selected at random, had arithmetic mean roughness Ra of 0.047 μm, maximum roughness-height Ry of 0.762 μm, and ten-point average roughness Rz of 0.538 μm, as specified above.

The auxiliary amalgam according to Comparative Example 1 comprises a base, a nickel layer formed on the base, and a lustrous metal layer, or lustrous Au layer, formed by ordinary electroplating. The base is a stainless-steel plate that is 2 mm wide, 7 mm long and 40 μm thick, like the base 31*a*. The nickel layer is 0.5 m thick, like the nickel layer 33. Like the metal layer 32*a*, the metal layer comprises at least 98% by mass of gold and contains, as impurities, nickel, cobalt and the like. Like the metal layer 32*a*, it has a mean thickness of 1.0 μm. This metal layer was made by electroplating using an acidic bath. Some surface region of this metal layer, selected at random, had arithmetic mean roughness Ra of 0.01 μm, maximum roughness-height Ry of 0.285 μm, and ten-point average roughness Rz of 0.01 μm.

Figure 12:
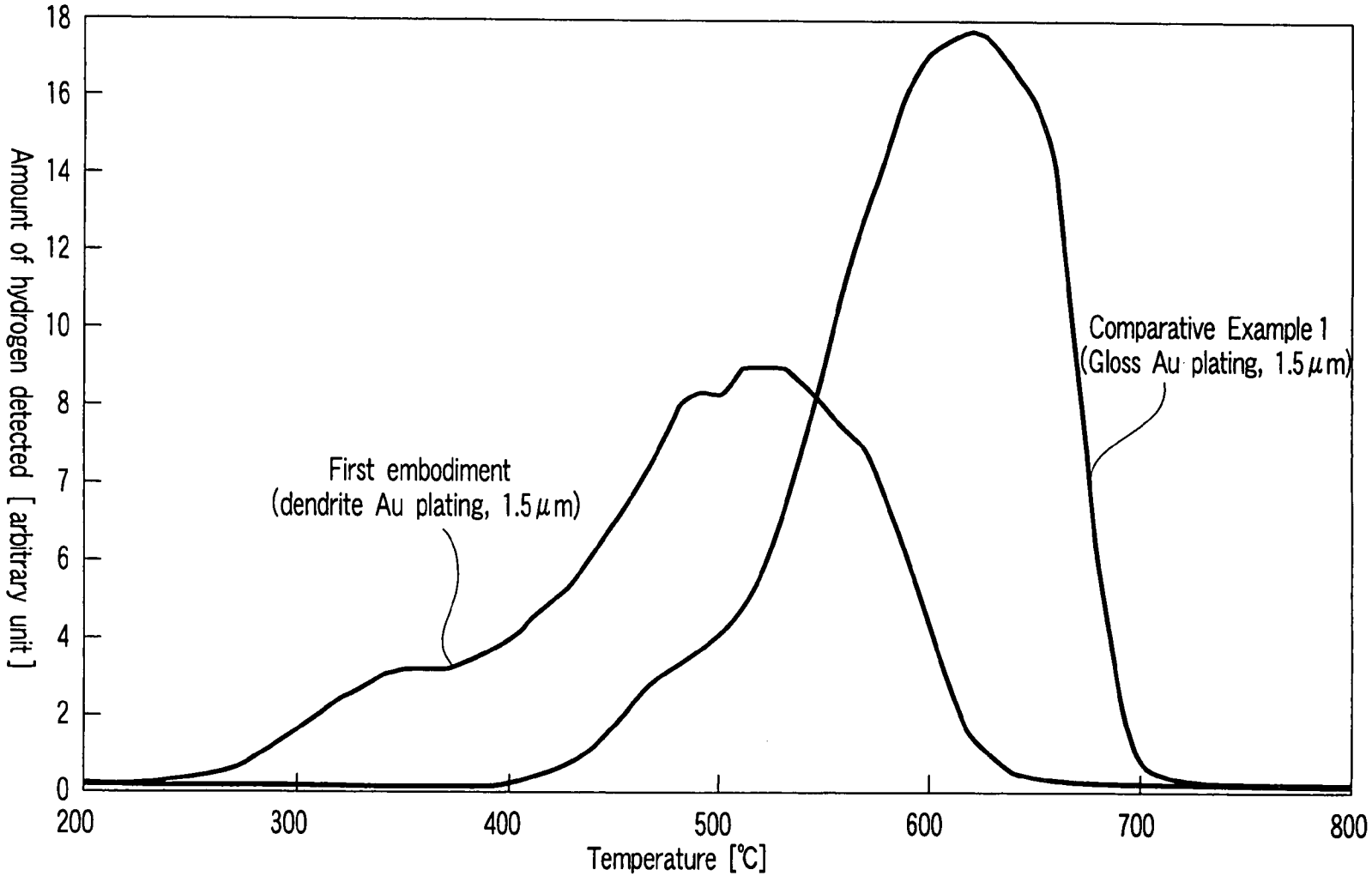
FIG. 12 is a graph representing the relation between the temperature of the first auxiliary amalgam and the detected amount of hydrogen, observed in the fluorescent lamp according to the first embodiment, and the relation between the temperature of the amalgam and the detected amount of hydrogen, observed in Comparative Example 1.

The amount of hydrogen absorbed was measured by a quadrupole mass spectrometry. Quadrupole mass spectrometry can determine the components of gas released from a sample heated in vacuum and the composition of the gas. FIG. 12 shows the results of the quadrupole mass spectrometry. More correctly, FIG. 12 shows the relation between the temperature of the auxiliary amalgam 30*a* and the detected amount of hydrogen released from the amalgam 30*a*, and the relation between the temperature of the auxiliary amalgam of Comparative Example 1 and the detected amount of hydrogen released from this auxiliary amalgam.

As seen from FIG. 12, the maximum amount of hydrogen detected of the auxiliary amalgam 30*a* that has the metal layer 32*a* formed by dendrite electroplating was smaller than the maximum amount of hydrogen detected of the auxiliary amalgam that has a metal layer formed by the ordinary electroplating. Thus, the total amount of hydrogen detected of the auxiliary amalgam 30*a* was smaller than the total amount of hydrogen detected of the auxiliary amalgam according to Comparative Example 1. The analysis of the results of quadrupole mass spectrometry teaches that the amount of hydrogen that the auxiliary amalgam 30*a* absorbs was about half the amount of hydrogen that the auxiliary amalgam of Comparative Example 1 absorbs. Hence, the auxiliary amalgam 30*a* having the metal layer 32*a* formed by dendrite electroplating (using an alkaline bath) can be said to absorb less hydrogen than any auxiliary amalgam that has been formed by the ordinary electroplating (using an acidic bath).

As FIG. 12 shows, more hydrogen was detected at low temperatures from the auxiliary amalgam 30*a* having the metal layer 32*a* formed by dendrite electroplating, than from the auxiliary amalgam having a metal layer formed by the ordinary electroplating. In other words, the auxiliary amalgam 30*a* having the metal layer 32*a* formed by dendrite electroplating can remove more hydrogen than any auxiliary amalgam that has a metal layer formed by the ordinary electroplating, when subjected to a low-temperature heating process.

Hence, the auxiliary amalgam 30*a* can remove more hydrogen than the conventional auxiliary amalgam in the heating step performed in the manufacture of the fluorescent lamp 12. The fluorescent lamp 12, which has this auxiliary amalgam 30*a*, can operate at a lower starting voltage than any fluorescent lamp that comprises the conventional auxiliary amalgam. Moreover, the auxiliary amalgam 30*a* serves to suppress the decrease of the ultraviolet-ray output of the fluorescent lamp 12.

The light-emitting tube 20 is formed such that the bent tubes 21*a*, 21*b* and 21*c* have height H2 of 50 to 60 mm, the tube 20 has a discharge path is 200 to 350 mm long, and the bent tubes 21*a*, 21*b* and 21*c* have a maximum width D3 of 32 to 43 mm in their juxtaposed direction (see FIG. 1). The light-emitting tube 20 is filled with argon gas at a filling pressure of 400 to 800 Pa, constituting at least 99% of all gas in the tube 20.

The bulb-shaped fluorescent lamp 10 will be further described, referring the cap 42 as the upper end, and the globe 60 as the lower end.

The cover 40 comprises the cover body 41, the cap 42, and the holder 43, and has an accommodating space therein for accommodating the lamp-driving device 50. The cap 42 is provided at one end (upper end) of the cover body 41. The holder 43 holds the fluorescent lamp 12 that is provided at the other end (lower end) of the cover body 41. It is desired that the cover body 41 be separated from the holder 43. Nonetheless, the cover body 41 and the holder 43 may be integrally formed.

The cover body 41 is made of heat-resistant synthetic resin such as polybutylene terephthalate (PBT). As FIG. 1 depicts, the cover body 41 is shaped like a hollow cylinder, flaring from one end (upper end) to the other end (lower end). The cap 42, such as an E26-type cap, is mounted on one end of the cover body 41. The cap 42 is secured to the cover body 41 with adhesive or by means of caulking. The cap 42 need not be directly attached to the cover body 41. It may be indirectly coupled to the cover body 41 or may constitute an integral part of the cover body 41.

The holder 43, which holds the lamp-driving device as well as the light-emitting tube, is secured to the other end of the cover body 41. The holder 43 has a port through which an end part of the light-emitting tube 20 can pass. The light-emitting tube 20 is attached to the holder 43, which is secured to the cover body 41 and covers the opening of the cover body 41. Coupling means (not shown) couples the substrate 51 of the lamp-driving device 50 to the holder 43.

As shown in FIG. 1, the lamp-driving device 50 has a plurality of electronic components 52, in addition to the substrate 51. The substrate 51 is arranged, perpendicular to the axis X passing the center 01 of the cap 42. The electronic components 52 are mounted on the substrate 51. The lamp-driving device 50 is an inverter circuit (high-frequency lamp-driving device). The lamp-driving device 50 is provided in the cover 40 such that the substrate 51 is secured and most of the electronic components 52 are arranged at the cap 42. The lamp-driving device 50 is electrically connected to the cap 42 and the fluorescent lamp 12. Receiving power through the cap 42, the device 50 operates, supplying high-frequency power to the filament coil 27 that acts as an electrode and making the fluorescent lamp 12 emit light. The lamp-driving device 50 has a smoothing electrolytic capacitor, like most types of lamp-driving devices. Nonetheless, the device 50 may not have such capacitors.

The substrate 51 is shaped like a disc. It has a diameter (i.e., maximum size) that is at most 1.2 times the maximum width of the light-emitting tube 20. Most of the electronic components 52, including the smoothing electrolytic capacitor, inductors, a transformer, resistors and film capacitors, are mounted on one surface (upper surface) of the substrate 51, which lies in the cap 42. The other electronic components, including field-effect transistors (FETs), rectifying diodes (RECs) and chip resistors, are mounted on the other surface (lower surface) of the substrate 51, which lies in the light-emitting tube 20.

The globe 60 is either transparent or opaque, capable of transmitting light or dispersing light. The globe 60 is made of glass or synthetic resin. It is similar in shape to ordinary glass bulbs and has a curved surface. The globe 60 has an opening at one end (upper end). The globe 60 contains the fluorescent lamp 12 and connected, at the opening, to the other end of the cover 40. The globe 60 may have a diffusion film or the like, to enhance the uniformity of luminance.

The lamp-driving device 50 is configured to make the fluorescent lamp 12 emit light, by supplying lamp power of 7 to 15 W and setting the current density (current per unit area) to 3 to 5 mA/mm$^2$ in the light-emitting tube 20. The bulb-shaped fluorescent lamp 10 is of a rated input power of 8 W, and high-frequency power of 7 W is supplied to the light-emitting tube 20. The lamp current is 120 mA, and the lamp voltage is 80V. As the light-emitting tube 20 emits light, the total luminous flux of the bulb-shaped fluorescent lamp 10 amounts to about 480 lm.

Figure 13:
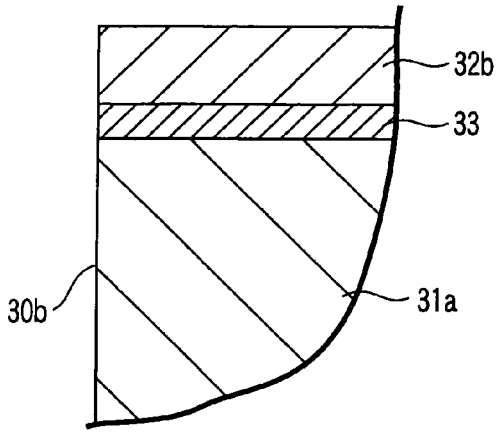
FIG. 13 is a partly magnified sectional view illustrating a second auxiliary amalgam that may replace the first auxiliary amalgam in the fluorescent lamp according to the first embodiment.
Figure 14:
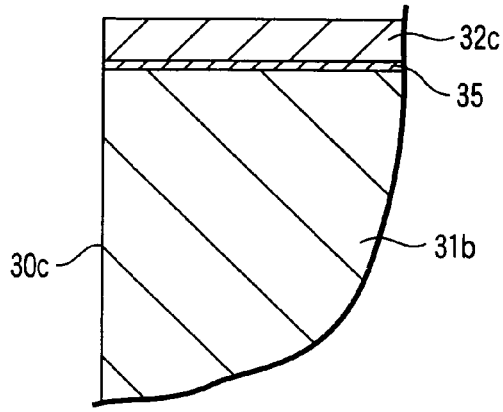
FIG. 14 is a partly magnified sectional view illustrating a third auxiliary amalgam that may replace the first auxiliary amalgam in the fluorescent lamp according to the first embodiment.

Other two types of auxiliary amalgam than can be used in the fluorescent lamp 12, in place of the first auxiliary amalgam 30*a*, will be described with reference to FIGS. 13 and 14.

The auxiliary amalgam 30*b* shown in FIG. 13 (hereinafter, referred to as second auxiliary amalgam) comprises a base 31*a*, a metal layer 32*b* and a nickel layer 33 provided between the base 31*a* and the metal layer 32*b*. The base 31*a*, metal layer 32*b* and nickel layer 33 are identical to those of the first auxiliary amalgam 30*a* in terms of material, thickness and the like. The metal layer 32*b* has an arithmetic mean roughness Ra of 0.01 μm, a maximum roughness-height Ry of 0.285 μm, and ten-point average roughness Rz of 0.155 μm. The metal layer 32*b* may be formed by, for example, ordinary bright electroplating.

The auxiliary amalgam 30*c* shown in FIG. 14 (hereinafter, referred to as third auxiliary amalgam) comprises a base 31*b*, which is a plate having a thickness of 40 μm and a size of 2×7 mm and made mainly of molybdenum. A peeling-inhibiting layer 35 having a thickness of about 0.01 μm and made mainly of nickel is formed on the base 31*b*. The peeling-inhibiting layer 35 is provided to lay the metal layer 32*c* firmly on the base 31*b*. It is not indispensable. On the peeling-inhibiting layer 35, the metal layer 32*c* is formed. The metal layer 32*c* is identical in material to the first amalgam 30*a* described above. The metal layer 32*c* has a thickness of 0.5 μm. The metal layer 32*c* has an arithmetic mean roughness Ra of 0.01 μm, a maximum roughness-height Ry of 0.285 μm, and ten-point average roughness Rz of 0.01 μm. The metal layer 32*c* may be formed by, for example, ordinary bright electroplating.

Bulb-shaped fluorescent lamps 10 comprising the above-mentioned fluorescent lamps 12 provided with the first to third auxiliary amalgams 30*a*, 30*b* and 30*c*, respectively, were tested to determine their flux-startup characteristics. The results were as follows.

Figure 15:
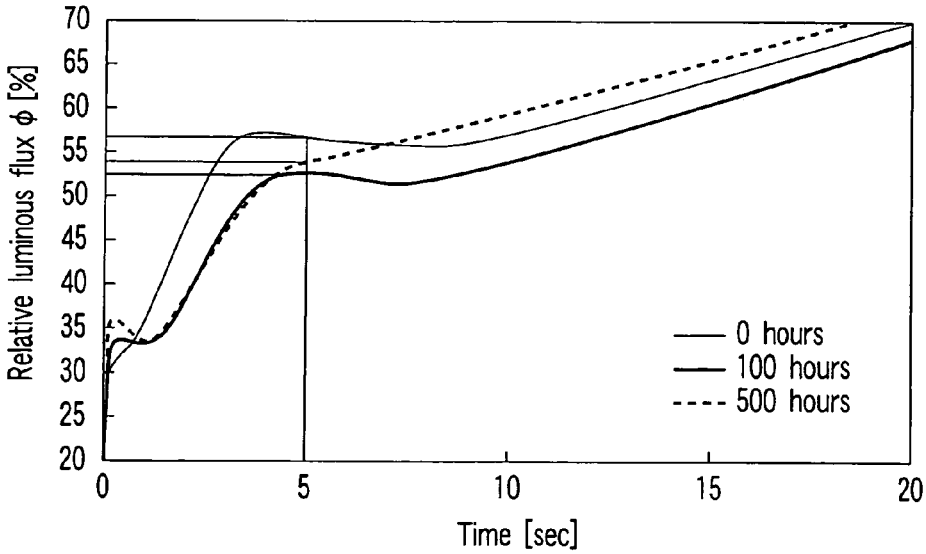

The bulb-shaped fluorescent lamp 10 having the first auxiliary amalgam 30*a* was measured for its flux-startup characteristic (i.e., the luminous flux change with time with respect to the value, set at 100%, after the time when the lamp 10 starts operating in the stable state). As seen from FIGS. 15 and 19, the relative luminous flux (flux-startup characteristic) was 56.6% upon lapse of 5 seconds from the time the lamp 10 was turned on, after the lamp 10 had been turned on for 0 hours in total. The relative luminous flux was 52.4% upon lapse of 5 seconds from the time the lamp 10 was turned on, after the lamp 10 had been turned on for 100 hours in total. The relative luminous flux was 54.0% upon lapse of 5 seconds from the time the lamp 10 was turned on, after the lamp 10 had been turned on for 500 hours in total.

Figure 16:
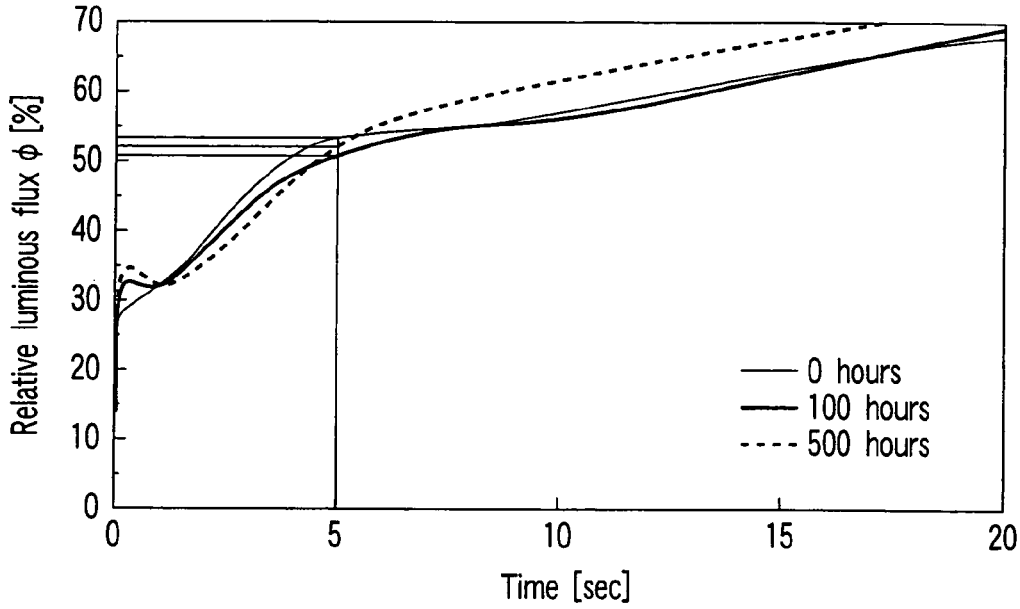

The bulb-shaped fluorescent lamp 10 having the second auxiliary amalgam 30*b* was measured for its flux-startup characteristics. As seen from FIGS. 16 and 19, the relative luminous flux was 53.3% upon lapse of 5 seconds from the time the lamp 10 was turned on, after the lamp 10 had been turned on for 0 hours in total. The relative luminous flux was 51.1% upon lapse of 5 seconds from the time the lamp 10 was turned on, after the lamp 10 had been turned on for 100 hours in total. The relative luminous flux was 51.8% upon lapse of 5 seconds from the time the lamp 10 was turned on, after the lamp 10 had been turned on for 500 hours in total.

Figure 17:
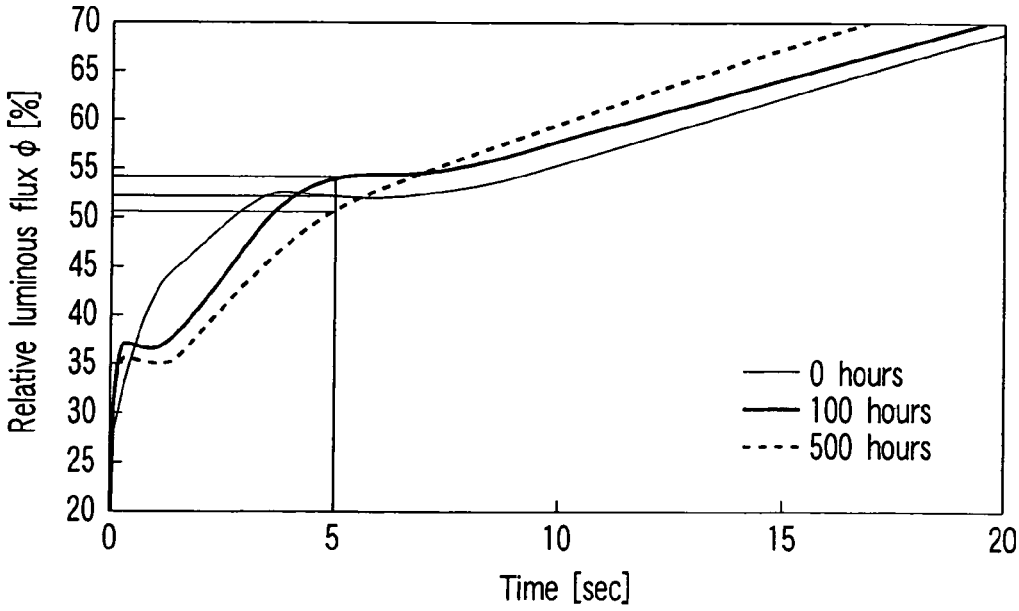

The bulb-shaped fluorescent lamp 10 having the third auxiliary amalgam 30*c* was measured for its flux-startup characteristics. As seen from FIGS. 17 and 19, the relative luminous flux was 51.7% upon lapse of 5 seconds from the time the lamp 10 was turned on, after the lamp 10 had been turned on for 0 hours in total. The relative luminous flux was 53.9% upon lapse of 5 seconds from the time the lamp 10 was turned on, after the lamp 10 had been turned on for 100 hours in total. The relative luminous flux was 50.9% upon lapse of 5 seconds from the time the lamp 10 was turned on, after the lamp 10 had been turned for 500 hours in total.

As Comparative Example 2, a bulb-shaped fluorescent lamp was prepared, which had a conventional auxiliary amalgam comprising a stainless-steel base on which gold was plated in a usual manner. The flux-startup characteristic of this bulb-shaped fluorescent lamp was measured. As shown in FIGS. 18 and 19, the bulb-shaped fluorescent lamp according to Comparative Example 2 exhibited a relative luminous flux of 49.8% upon lapse of 5 seconds from the time this lamp was turned on, after the lamp 10 had been turned on for 0 hours in total. The relative luminous flux was 45.9% upon lapse of 5 seconds from the time the lamp 10 was turned on, after the lamp had been turned on for 100 hours in total. The relative luminous flux was 42.6% upon lapse of 5 seconds from the time the lamp 10 was turned on, after the lamp had been turned on for 500 hours in total.

The bulb-shaped fluorescent lamp 10 comprising the auxiliary amalgam 30*a* having the nickel layer 33 provided between the metal layer 32*a* and the base 31*a* exhibited a relative luminous flux 6.5% greater than that of the bulb-shaped fluorescent lamp of Comparative Example 2 having the conventional auxiliary amalgam, after it had been turned on for 100 hours in total. The relative luminous flux of the lamp 10 after turning on for 500 hours in total was 11.4% greater than that of Comparative Example 2. Furthermore, the relative luminous flux that the lamp 10 exhibited in the initial state (i.e., after the lamp 10 had been turned on for 0 hours in total) was 6.8% greater than that of the bulb-shaped fluorescent lamp of Comparative Example 2.

The bulb-shaped fluorescent lamp 10 comprising the second auxiliary amalgam 30*b* having the nickel layer 33 provided between the metal layer 32*a* and the base 31*b* exhibited a relative luminous flux 5.2% greater than that of the bulb-shaped fluorescent lamp of Comparative Example 2, after it had been turned on for 100 hours in total. The relative luminous flux that the lamp 10 exhibited after it had been turned on for 500 hours in total was 9.2% greater than that of Comparative Example 2 exhibited under the same conditions. In addition, the relative luminous flux that the lamp 10 exhibited in the initial state was 3.5% greater than that of Comparative Example 2.

Thus, the nickel layer 33, which is provided between the base 31*a* and the metal layer 32*a* or 32*b*, is believed to inhibit the diffusion of gold from the metal layer 32*a* or 32*b* into the base 31*a*. Thanks to the use of the auxiliary amalgam 30*a* or 30*b*, the fluorescent lamp 12 can maintain the improved flux-startup characteristic for a long time.

Moreover, the bulb-shaped fluorescent lamp 10, which has the first auxiliary amalgam 30*b* whose metal layer 32*a* has a rough surface, generated a luminous flux 3.3% (relative value) greater after it had been used for 0 hours in total, a luminous flux 1.3% (relative value ) greater after it had been used for 100 hours in total, and a luminous flux 2.2% (relative value) greater after it had been used for 500 hours in total, than that of the bulb-shaped fluorescent lamp 10 that had the second auxiliary amalgam 30*b*.

As described above, the metal layer 32*a* is porous, with the filling ratio of the crystals set at about 80%. Some surface region of this metal layer, selected at random and differing in crystal size, had arithmetic mean roughness Ra of 0.047 μm, maximum roughness-height Ry of 0.762 μm, and ten-point average roughness Rz of 0.538 μm. This helps to inhibit the diffusion of gold from the metal layer 32*a* into the base 31*a*. Hence, the use of this auxiliary amalgam 30*a* can not only greatly enhance the flux-startup characteristic of the bulb-shaped fluorescent lamp 10, but also maintain this improved flux-startup characteristic for a long time.

The bulb-shaped fluorescent lamp 10 comprising the third auxiliary amalgam 30*c* generated a luminous flux 8.0% (relative value) greater after it had been used for 100 hours in total and a luminous flux 8.3% (relative value) greater after it had been used for 500 hours in total, than the luminous flux generated by the bulb-shaped fluorescent lamp according to Comparative Example 2, which has a conventional auxiliary amalgam. Further, the luminous flux that the lamp 10 generated in the initial state was 1.9% (relative value) greater than the luminous flux that the bulb-shaped fluorescent lamp according to Comparative Example 2 generated in the initial state.

Gold in the metal layer 32*c* scarcely diffuses into the base 31*b*. This is probably because the base 31*b* is made mainly of molybdenum. Hence, the auxiliary amalgam 30*c* enables the fluorescent lamp 12 to maintain the improved flux-startup characteristic for a long time even though its metal layer 32*c* is thinner than that of the conventional auxiliary amalgam.

Another type of auxiliary amalgam that can be used in the fluorescent lamp 12, in place of the first auxiliary amalgam 30*a*, will be described with reference to FIG. 20.

The auxiliary amalgam 30*d* shown in FIG. 20 (hereinafter, referred to as "fourth auxiliary amalgam") comprises a base 31*a* that is identical to the base of the first auxiliary amalgam 30*a*. The base 31*a* a stainless-steel plate that has a thickness of 40 μm and a size of 2×7 μm. A peeling-inhibiting layer 35*a* made mainly nickel and having a thickness of about 0.01 μm is formed on the base 31*a*. A diffusion-inhibiting layer 34 made mainly of molybdenum and having a thickness of about 0.05 μm is formed on the peeling-inhibiting layer 35*a*. Further, a peeling-inhibiting layer 35 made mainly of nickel and having a thickness of about 0.01 μm is formed on the diffusion-inhibiting layer 34. On this peeling-inhibiting layer 35*b* there is formed a metal layer 32*c*. The metal layer 32*c* is made of the same material as its counterpart of the first auxiliary amalgam 30*a* and has a thickness of 0.5 μm. The metal layer 32*c* has arithmetic mean roughness Ra of 0.01 μm, maximum roughness-height Ry of 0.285 μm, and ten-point average roughness Rz of 0.01 μm. The metal layer 32*c* can be formed by, for example, ordinary bright electroplating. The peeling-inhibiting layer 35*a* is provided to lay the diffusion-inhibiting layer 34 firmly on the base 31*b*, and is not indispensable. Similarly, the peeling-inhibiting layer 35*b* is provided to lay the metal layer 32*c* firmly on the diffusion-inhibiting layer 34, and is not indispensable.

In the fluorescent lamp 12 comprising the fourth auxiliary amalgam, gold in the metal layer 32*c* scarcely diffuses into the diffusion-inhibiting layer 34 that is made mainly of molybdenum. Hence, the auxiliary amalgam 30*d* enables the fluorescent lamp 12 to maintain the improved flux-startup characteristic for a long time even though its metal layer 32*c* is thinner than that of the conventional auxiliary amalgam.

Generally speaking, stainless steel is less expensive than molybdenum. The amalgam 30*d* that comprises the base 31*a* made of stainless steel and has the diffusion-inhibiting layer 34 made mainly of molybdenum can therefore be manufactured at a lower cost than the third amalgam 30*c* that has the base 31*b* made mainly of molybdenum.

Figure 21:
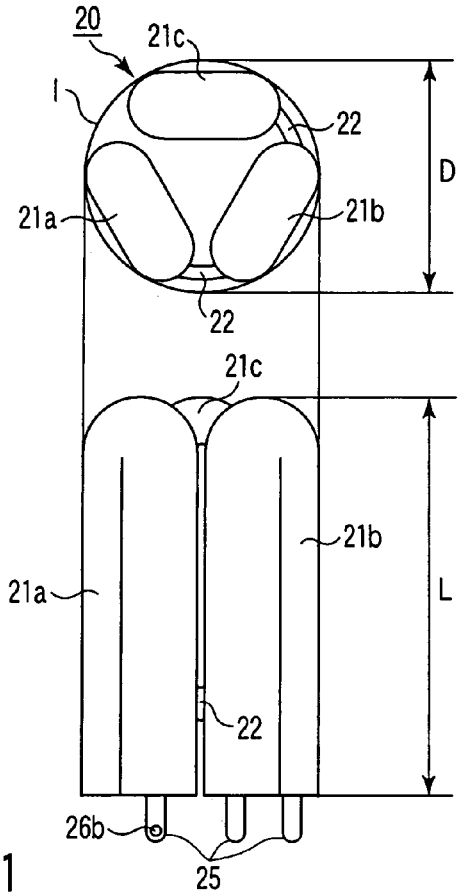
FIG. 21 is a diagram, explaining how to measure the surface area of the light-emitting tube that is provided in the fluorescent lamp according to a second embodiment.

The second embodiment of the present invention will be described, with reference to FIGS. 21 and 22. This embodiment is applied to a fluorescent lamp and a bulb-shaped fluorescent lamp comprising this fluorescent lamp.

This bulb-shaped fluorescent lamp 10 comprises a lamp-driving device 50. The device 50 supplies a lamp-output power of 7 to 15 W, setting the current density (current per unit area) in the light-emitting tube 20 to 3 to 5 mA/mm$^2$, thereby to drive the fluorescent lamp 12. The fluorescent lamp 12 of the second embodiment has a rated input power of 8 W. Power of 7 W is supplied to the light-emitting tube 20 at a high frequency. The lamp current is 120 mA, and the lamp voltage is 80V. The light-emitting tube 20 emits light, providing a total luminous flux of about 480 lm. The electrodes 27 generate heat, and electric discharge takes place in the discharge path. The fluorescent lamp 12 therefore emits light. While the fluorescent lamp 12 remains on, the temperature in the vicinity of the electrodes 27 of the bent tubes 21*a* and 21*c* is 100 to 120° C., the temperature at the straight tubes 23 is 70 to 80° C., the temperature at the tops of the curved parts 24 is about 55° C., and the temperature in the globe 60 is 50 to 60° C.

By the turning-on of the fluorescent lamp 12, the centers of discharge formed in the bent tubes 21*a*, 21*b* and 21*c* become shifted to the shortest distance side at the tops of the curved parts 24. Therefore, the distance between the top of each curved part 24 and the discharge path becomes long. The temperature in the globe 60 and the temperature in the tops of the curved parts 24 are about 50 to 60° C., but not so high, falling within a tolerance range, and can control the mercury-vapor pressure to provide a high lamp efficiency. Therefore, the main amalgam 26*b* can be made of an amalgam having a relatively high vapor pressure of mercury, for example, alloy composed of 49% by mass of bismuth (Bi), 36% by mass of tin (Sn) and 15% by mass of mercury (Hg). If the main amalgam 26*b* provide a high mercury-vapor pressure, the mercury-vapor pressure in the light-emitting tube 20 can remain relatively high even at normal temperature (25° C. in this instance). This can improve the flux-startup characteristic of the fluorescent lamp 12. The auxiliary amalgam used is, for example, the first auxiliary amalgam 30*a* described above. Nonetheless, the auxiliary amalgam 30*a* may be replaced by the second auxiliary amalgam 30*b*, the third auxiliary amalgam 30*c* or the fourth auxiliary amalgam 30*d*. The second embodiment is identical to the first embodiment, in any other structural feature. Therefore, any identical structural feature will not be described.

As the fluorescent lamp 12 operates in the stable state, its temperature rises because the globe 60 covers the lamp 12. A part of the light-emitting tube 20 of the fluorescent lamp 12 can be set at 70° C. or less by controlling the temperature that is determined from the surface area of the heat-generating part and the input power. This can improve the flux-startup characteristic of the fluorescent lamp 12.

The bulb-shaped fluorescent lamp 10 according to the present embodiment was compared with the bulb-shaped fluorescent lamps according to Comparative Examples 3, 4, 5 and 6 in terms of flux-startup characteristic observed until the luminous flux attains 80% of its rated maximum value. The flux-startup characteristic of each lamp was determined by supplying the commercially available 100-V power to the lamp, maintaining the ambient temperature at 25° C. and positioning the lamp with the cap 42 directed upwards in no wind state. The current input and the power consumed were 140 mA and 8 W, respectively, for all bulb-shaped lamps compared.

The bulb-shaped fluorescent lamp according to Comparative Example 3 comprises main amalgam (Bi (49% by mass)—Sn (36% by mass)—Hg (15% by mass), which is similar to that of the bulb-shaped fluorescent lamp 10 according to this embodiment. It has auxiliary amalgam that is made mainly of indium.

The bulb-shaped fluorescent lamp according to Comparative Example 4 has main amalgam (Bi (49% by mass)—Sn (36% by mass)—Hg (15% by mass), which is similar to that of the bulb-shaped fluorescent lamp 10 according to this embodiment. It has no auxiliary amalgam at all.

The bulb-shaped fluorescent lamp according to Comparative Example 5 has main amalgam (Bi (44% by mass)—Pb (19% by mass)—Sn (34% by mass)—Hg (4% by mass), which provides a lower mercury-vapor pressure than the main amalgam used in the bulb-shaped fluorescent lamp 10 according to this embodiment. It has auxiliary amalgam that is made mainly of gold.

The bulb-shaped fluorescent lamp according to Comparative Example 6 has main amalgam (Bi (44% by mass)—Pb (18% by mass)—Sn (34% by mass)—Hg (4% by mass), which is similar to that of Comparative Example 5. It has auxiliary amalgam that is made mainly of indium.

Figure 22:
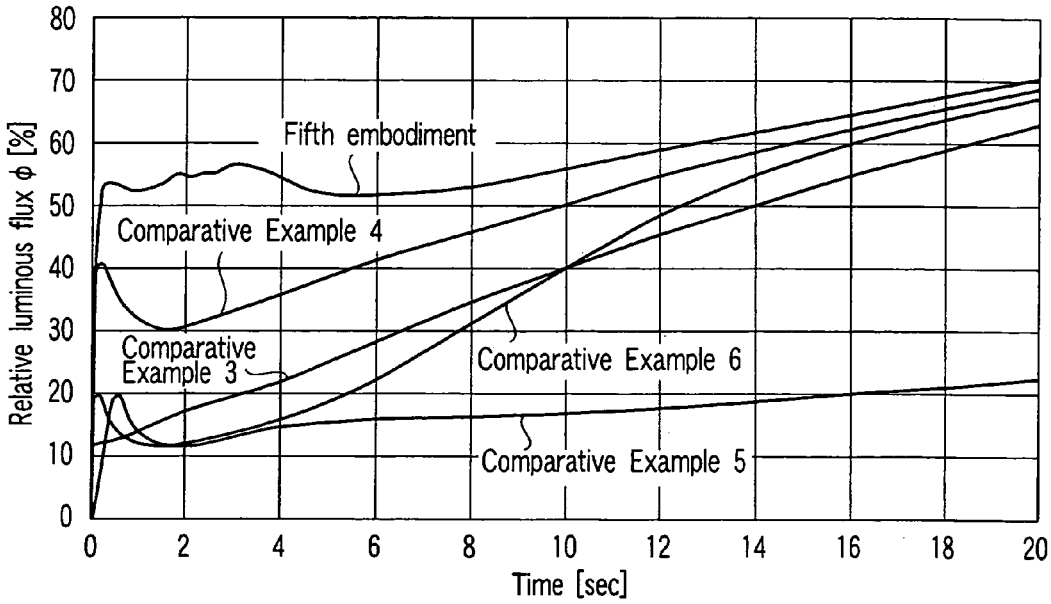
FIG. 22 is a graph illustrating how the luminous flux emitted by the fluorescent lamp according to the second embodiment and those emitted by the fluorescent lamps of Comparative Examples 3, 4, 5 and 6 changes with time.

FIG. 22 shows the results of determining the flux-startup characteristics of the lamps compared, namely illustrating how the luminous flux emitted from each lamp changed with time. The luminous fluxes emitted immediately after the lamp was turned on were:

This embodiment>Comparative Example 4>Comparative Example 5≧Comparative Example 6>Comparative Example 3.

The luminous fluxes emitted from Comparative Examples 4 to 6 sharply decreased after the lamps were turned on, and the luminous fluxes emitted upon lapse of 1 second from the turning-on were:

Embodiment>Comparative Example 4>Comparative Example 3≧Comparative Example 6>Comparative Example 5.

About 2 seconds from the turning-on, the lamp efficiencies (relative luminous fluxes) of Comparative Examples 3 to 6 started increasing. However, it took 10 seconds or more for Comparative Examples 3, 5 and 6 to have their luminous fluxes of 40% of their entire flux values.

By contrast, in the bulb-shaped fluorescent lamp 10 according to the present embodiment, the mercury-vapor pressure is high when the lamp 10 remains off. This is because the lamp 10 uses main amalgam 26*b* that can provide a high mercury-vapor pressure. Further, the luminous flux quickly increases, because the auxiliary amalgam 30*a* releases mercury in an appropriate amount immediately after the lamp 10 is turned on, and thus there is no insufficiency of mercury. It was confirmed that the lamp 10 of this embodiment attained, within 1 second after it was turned on, about 50% or more of the light output attained at the time when the lamp 10 operates in the stable state.

The inventors hereof conducted the following experiment to find the fact that will be described later. The light-emitting tube 20 has a surface area S, which is substantially represented by:

$$S=\pi DL+2\times(\pi/4)D^2 \quad (3)$$

where D is the diameter of a circle I surrounding the circumference of the light-emitting tube 20, and L is the length of the light-emitting tube 20.

The inventors found that the light-emitting tube 20 operating in the normal state can have a part remaining at 70° C. or less, if the surface area S of the light-emitting tube 20 has the following relation with the lamp output P:

$$P/S<0.12 \quad (4)$$

The inventors also found that mercury or main amalgam 26*b* can be sealed to provide a mercury-vapor pressure of 0.15 Pa or more at normal temperature (25° C.) if the light-emitting tube 20 has a part that is at 70° C. or less even while the lamp is operating in the normal state.

A bulb-shaped fluorescent lamp having no globes 60 can operate in the same way if the following relation holds true:

$$P/S<0.18 \quad (5)$$

The fluorescent lamp 12 according to this embodiment can maintain an improved flux-startup characteristic for a long time, as in the first embodiment. In addition, the mercury-vapor pressure can be high while the lamp 12 remains off, because the lamp 12 has the main amalgam 26*b* that provides a mercury-vapor pressure of 0.04 Pa or more at 25° C. This can enhance the flux-startup characteristic.

In the fluorescent lamp 12 according to this embodiment, the light-emitting tube 20 is so designed that the surface area S of the light-emitting tube 20 and the lamp output P have the relation of the formula (4). The light-emitting tube 20 can therefore have a low-temperature part that remains at 70° C. or less even while the lamp 12 is operating in the normal state. Thus, the light-emitting tube 20 can contain mercury or the main amalgam 26*b* that provides a mercury-vapor pressure-of 0.15 Pa or more at 25° C. This enables the fluorescent lamp 12 according to this embodiment to have its flux-startup characteristic improved even more, as compared to the fluorescent lamp of the first embodiment.

The third embodiment of the present invention will be described, with reference to FIGS. 23 and 24. This embodiment is a fluorescent lamp and a bulb-shaped fluorescent lamp comprising the fluorescent lamp.

Figure 23:
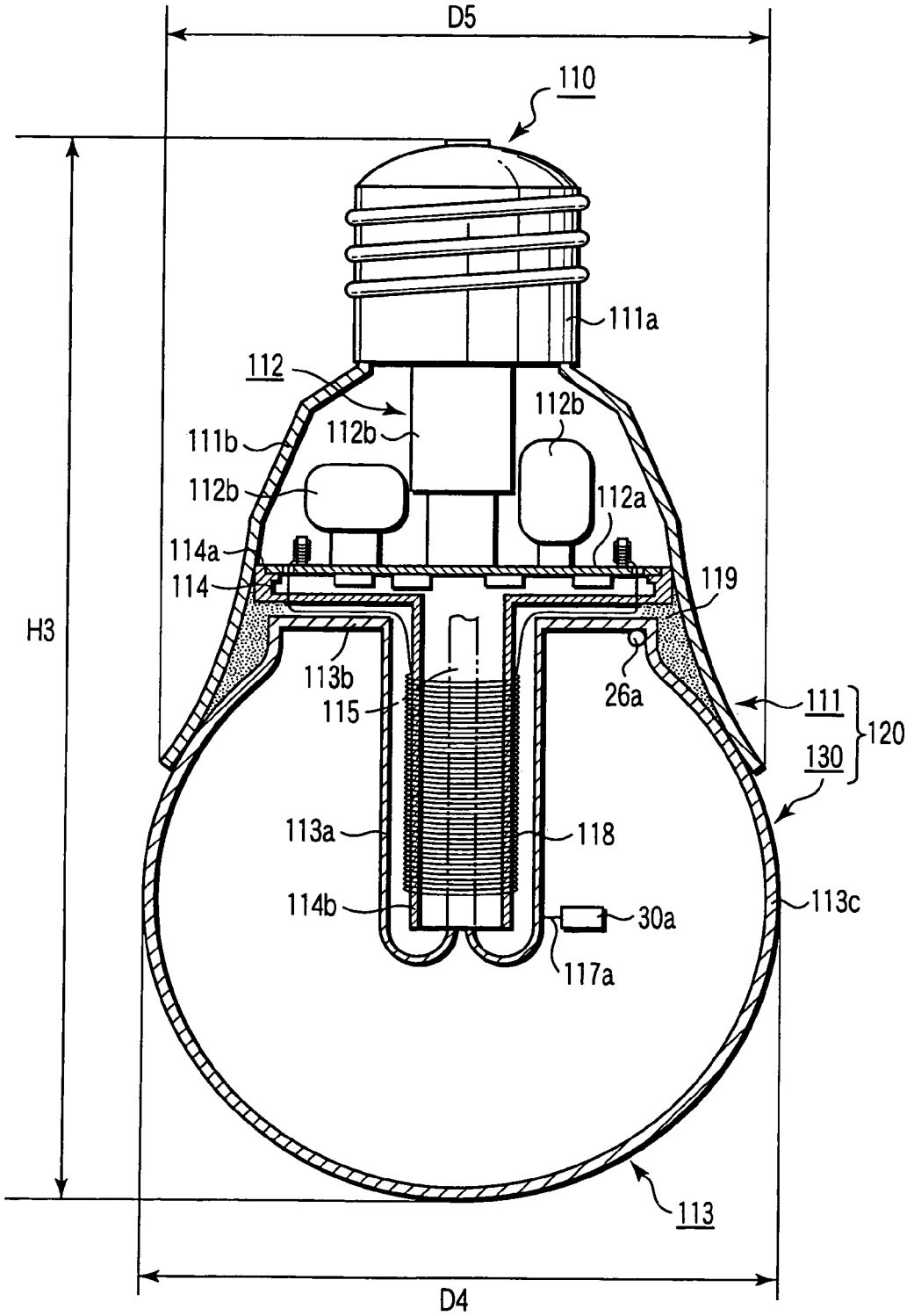
FIG. 23 is a sectional view depicting a fluorescent lamp according to a third embodiment of the present invention.

FIG. 23 depicts the electrode-less bulb-shaped fluorescent lamp 110 as a bulb-shaped fluorescent lamp. The electrode-less bulb-shaped fluorescent lamp 110 comprises an electrode-less fluorescent lamp 130 as a fluorescent lamp, a cover 111, and a lamp-driving device 112. The cover 111 comprises a cover body 111*b*, a cap 111*a*, and a holder 114. The cap 42 is provided at one end of the cover body 111*b*. The holder 114 is provided at the other end of the cover body 111*b* and used as a holding part. The lamp-driving device 112 is contained in the cover 111. The electrode-less fluorescent lamp 130 is shaped like a bulb. The holder 114 holds the fluorescent lamp 130.

The fluorescent lamp 130 and the cover 111 constitute an envelope 120. The envelope 120 is formed, having a size similar to the standard size of bulbs for general lighting use, such as incandescent lamps which have the rated power of 60 W. The fluorescent lamp 130 has height H3 of about 110 to 140 mm, including that of the cap 111*a*, and outside diameter D4 of about 50 to 70 mm. The cover 111 has outside diameter D5 of about 50 mm. The phrase "bulbs for general lighting use" means the bulbs defined at JIS C 7501.

The fluorescent lamp 130 comprises a light-emitting tube 113, a mercury pellet 26*c* (Zn (50% by mass)—Hg (50% by mass), and auxiliary amalgam 30*a*. The light-emitting tube 113 is made of material transparent to light such as glass and shaped like a ball. More precisely, the light-emitting tube 113 has a ball-shaped part 113*c*, a ring-shaped edge part 113*b*, and a hollow part 113*a*. The ball-shaped part 113*c* has an opening at one end. The edge part 113*b* extends inwards from the rim of the opening. The hollow part 113*a* is hollow cylinder having a bottom and extending from the tip end of the edge part 113*b* substantially toward the center of the ball-shaped part 113*c*. The ball-shaped part 113*c*, edge part 113*b* and hollow part 113*a* are integrally formed.

An exhaust pipe 115 is provided in the hollow part 113. The pipe 115 extends from the center of the bottom toward the opening (toward the edge part 113*b*) along the axis of the hollow part 113*a*. The mercury pellet 26*c* is sealed in the light-emitting tube 113 and positioned near the edge part 113*b*. The mercury pellet 26*c* is secured to, for example, the inner surface of the edge part 113*b*. The In the fluorescent lamp 130, the mercury pellet 26*c* may be replaced by the main amalgam 26*b* for use in the fluorescent lamp 12 according to the second embodiment.

A wire 117*a* as a supporting member extends from the hollow part 113*a* that lies in the discharge space within the light-emitting tube 113. Auxiliary amalgam 30*a* is attached the wire 117*a*. The main amalgam 30*a* releases the mercury adsorbed to it during the initial phase of light-emission, in order to enhance the flux-startup characteristic. The auxiliary amalgam 30*a* provided in the fluorescent lamp 130 is identical to the first auxiliary amalgam 30*a* described above. The auxiliary amalgam 30*a* may be replaced by any one of the second to fourth auxiliary amalgams 30*b*, 30*c* and 30*d*. The auxiliary amalgam 30*a* is supported by the wire 117*a* attached to the hollow part 113*a*, but its position is not particularly limited. Further, the shape of the auxiliary amalgam 30*a* is not limited to a particular one.

An alumina ($Al_2O_3$) protection film (not shown) is formed on the inner surface of the light-emitting tube 113, or on the inner surface of the ball-shaped part 113*c* and outer surface of the hollow part 113*a*. A phosphor layer (not shown) made of three-wave emitting phosphor is formed on the alumina protective film.

The light-emitting tube 113 is filled with argon gas at a filling pressure of 100 to 300 Pa, constituting at least 99% of all gas in the tube 20.

The lamp-driving device 112 has a disc-shaped circuit board 112*a* and a plurality of electronic components 112*b*. The electronic components 112*b* are mounted on the circuit board 112*a*.

The lamp-driving device 112 is secured to one side of the holder 114. The fluorescent lamp 130 is attached the other side of the holder 114. The holder 114 has a holding part 114*a* and a hollow cylindrical part 114*b*. The holding part 114*a* is flat and circular and can hold, on one side, the circuit board 112*a* of the lamp-driving device 112. The hollow cylindrical part 114*b* projects from the center of the other side of the holder part 114*a*. The holding part 114*a* and the hollow cylindrical part 114*b* are integrally formed. The hollow cylindrical part 114*b* is arranged in the region defined by the outer surface of the hollow part 113*a*. The exhaust pipe 115 is arranged in the hollow cylindrical part 114*b*.

The hollow cylindrical part 114*b* functions as a core around which an excitation coil is wound. An excitation coil 118, which generates a high-frequency magnetic field, is wound around the outer peripheral portion of the hollow cylindrical part 114*b*. A cylindrical core bar (not shown) made of ferrite is provided in the excitation coil 118.

The fluorescent lamp 130 and the holder 114 are attached to the cover body 111*b*, covering the opening made in one end (lower end) of the cover body 111*b*. Thus, the lamp-driving device 112 mounted on the holder 114 is placed in the space provided between the cover body 111*b* and the holder 114. The cap 111*a*, such as an E26-type cap, is mounted on the other end of the cover body 111*b*. The cap 111*a* is secured to the cover body 111*b* with adhesive or by means of caulking.

How the electrode-less, bulb-shaped fluorescent lamp 110 is assembled will be described below.

First, the holder 114 is prepared in which the lamp-driving device 112 is attached to the holding part 114*a*, and the coil 18 is wound around the hollow cylindrical part 114*b*. The fluorescent lamp 130 is attached to the holding part 114*a* that now holds the lamp-driving device 112. At this time, the light-emitting tube 113 and holder 114 are secured to the inner surface of one side (lower side) of the cover 111 by means of an adhesive such as a silicone resin. The cap 111*a* is attached to the cover 111. The electrode-less, bulb-shaped fluorescent lamp 110 is thereby assembled. The light-emitting tube 113, excitation coil 118 and lamp-driving device 112 may be coupled by any other method.

In the electrode-less, bulb-shaped fluorescent lamp 110, the excitation coil 118 and light-emitting tube 113 generates heat as a current flows through the coil 118. As a result, discharge takes place in the discharge path. The fluorescent lamp 130 emits light. That is, the lamp-driving device 112 receives the lamp power of 10 to 20 W and applies a tube-wall load of 500 to 1,000 W/m$^2$ to the light-emitting tube 113, causing the fluorescent lamp 130 to emit light. The electrode-less, bulb-shaped fluorescent lamp 110 according to this embodiment has a rated input power of 12 W. Power of 11 W is supplied at high frequency to the fluorescent lamp 130. When the fluorescent lamp 130 emits light, the electrode-less, bulb-shaped fluorescent lamp 110 provides a total luminous flux of about 800 lm.

In the electrode-less, bulb-shaped fluorescent lamp 110 according to this embodiment, the discharge space defines a surface area of 14,000 mm$^2$ and the tube-wall load is 790 W/m$^2$. A part of the light-emitting tube 113 remains at a relatively low temperature of 50° C. or less even while the tube 113 is emitting light. The main amalgam can therefore be one that provides a comparatively high mercury-vapor pressure. The mercury-vapor pressure in the light-emitting tube 113 can remain comparatively high at normal temperature (about 25° C.).

The electrode-less, bulb-shaped fluorescent lamp 110 according to the present embodiment and an electrode-less, bulb-shaped fluorescent lamp according to Comparative Example 7 were turned on and compared in terms of flux-startup characteristic observed until the luminous flux attains 80% of the rated maximum value. The flux-startup characteristic of each lamp was determined by supplying the commercially available 100-V power to the lamp, maintaining the ambient temperature at 25° C. and positioning the lamp with the cap 42 directed upwards in no wind state. The power consumed was about 12 W.

The electrode-less, bulb-shaped fluorescent lamp according to Comparative Example 7 comprises a mercury pellet of the same type as used in the electrode-less, bulb-shaped fluorescent lamp 110 according to this embodiment, but has no auxiliary amalgams.

Figure 24:
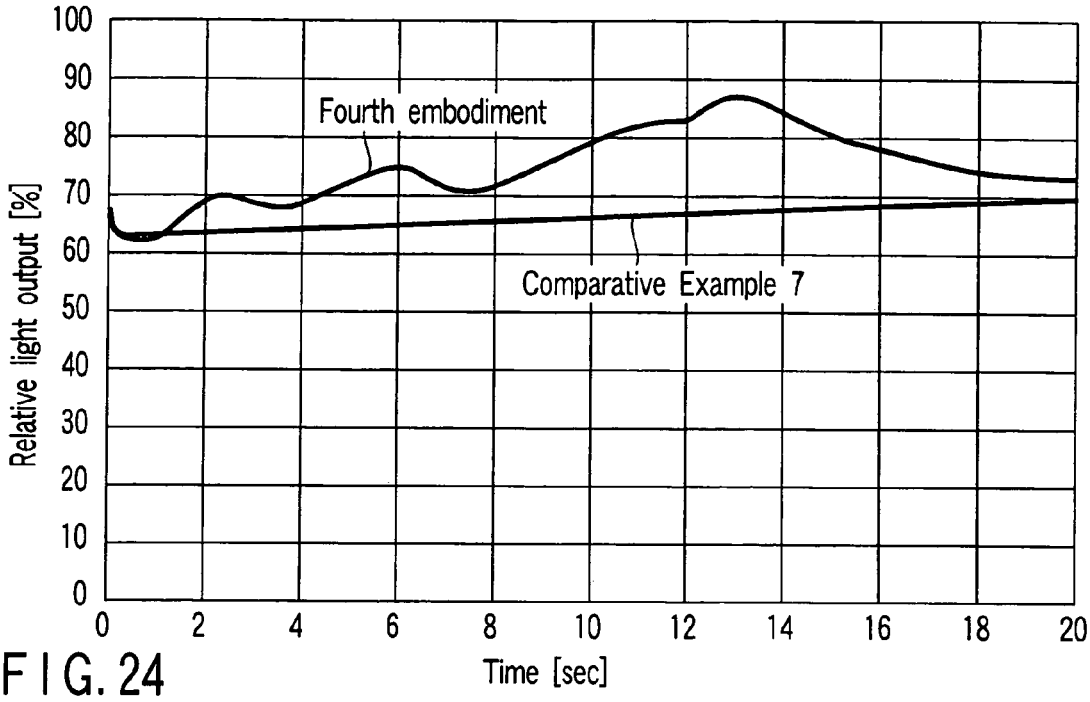
FIG. 24 is a graph illustrating how the luminous flux that the fluorescent lamp according to the third embodiment emits changes with time, and how the luminous flux that a fluorescent lamp of Comparative Example 7 emits changes with time.

FIG. 24 shows the characteristics determined. Namely, it illustrates how the luminous fluxes emitted from the fluorescent lamps changed with time. In terms of relative light output (relative luminous flux) immediately after turning-on, the lamps had the following relation:

This embodiment>Comparative Example 7

Immediately after the lamp according to Comparative Example 7 was turned on, its luminous flux sharply decreased. Even 1 second from the turning-on. In terms of relative light output, the lamps had the following relation in terms of relative light output:

This embodiment>Comparative Example 7

Using a mercy pellet that provides a relatively high mercy-vapor pressure, the lamp according to Comparative Example 7 output about 65% of the output value at the stable state, from the time when it is turned on. However, its output could not reach 70% or more of the output value at the stable state, after 20 seconds had passed from the turning-on.

By contrast, the mercury-vapor pressure is high in the electrode-less bulb-shaped fluorescent lamp 110 according to this embodiment, while the lamp 110 remains off. This is because the lamp 110 uses the main amalgam 26*b* that provides a high mercury-vapor pressure. Moreover, the auxiliary amalgam 30*a* releases mercury in an appropriate amount, causing no insufficiency of mercury. Thus, the luminous flux increases fast. It was confirmed that the light output of the present embodiment reached, within one second after turning on, about 50% or more of the value it should have while the lamp is operated in the stable state.

Having the auxiliary amalgam 30*a*, the electrode-less bulb-shaped fluorescent lamp 110 according to this embodiment can have an improved flux-startup characteristic for a long time, as in the first embodiment. Further, the mercury-vapor pressure can be high while the lamp 12 remains off, because the lamp 12 has the mercury pellet 26*c* that provides a mercury-vapor pressure of 0.04 Pa or more at 25° C. This can enhance the flux-startup characteristic.

Figure 25:
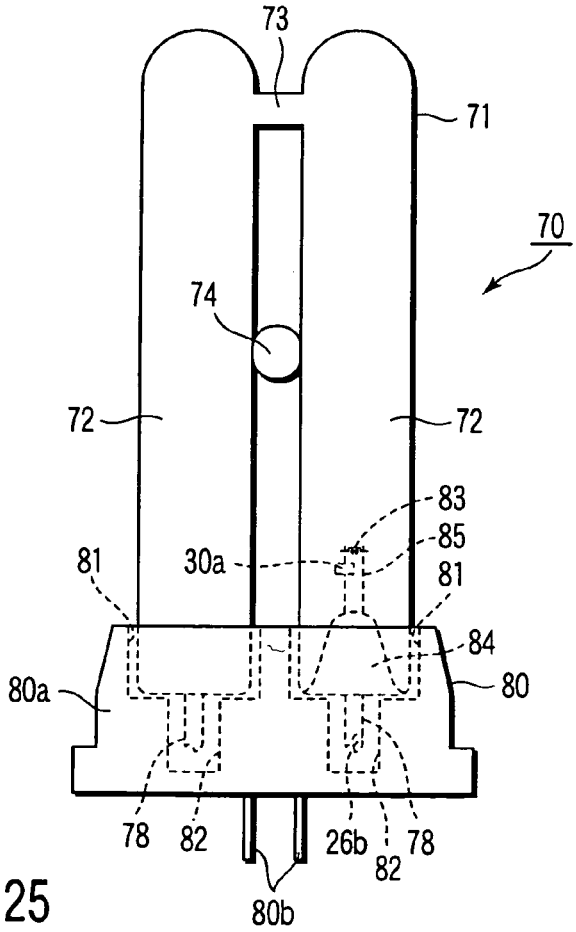
FIG. 25 is a side view showing a fluorescent lamp according to a fourth embodiment of this invention.

The fourth embodiment of the present invention will be described, with reference to FIG. 25. This embodiment is a compact fluorescent lamp. The compact fluorescent lamp 70 comprises a light-emitting tube 71, main amalgam 26*a*, auxiliary amalgam 30*a* and a cap 80.

The light-emitting tube 71 has straight bulbs that are made of glass transparent to light and have an inside diameter of 1 mm to 15 mm. More specifically, the light-emitting tube 71 has a pair of straight bulbs 72 that have an inside diameter of 13 mm and an outside diameter of 15 mm. The straight bulbs 72 are arranged side by side and communicate with each other at their distal-end parts, via a bridge-shaped connecting part 73. Thus, the light-emitting tube 71 is H-shaped. The straight bulbs 72 are fastened together, at middle part, with thermosetting adhesive 74, such as silicone resin. A phosphor film (not shown) is formed on the inner surface of the each bulb 72. The main amalgam is, for example, the main amalgam 26*b* described above. The auxiliary amalgam is, for example, the first auxiliary amalgam 30*a* described above. The main amalgam 26*b* may be replaced by the main amalgam 26*a*. The auxiliary amalgam 30*a* may be replaced by any one of the second to fourth auxiliary amalgams 30*b*, 30*c* and 30*d*.

The light-emitting tube 71 is filled with rare gas, such as argon, and mercury. The mercury filled in the tube 71 has resulted from the main amalgam 26*b* and auxiliary amalgam 30*a* that are sealed in the light-emitting tube 71.

The ends of the light emitting tube 71, or the capped ends of the straight bulbs 72, contain two filament electrodes 33, respectively. Each filament electrode 93 is supported through wells 85 by a stem 84. FIG. 25 shows only the filament electrode provided in one straight bulb 72. In the capped end of each straight bulb 72, a thin tube 78 is provided and extends toward the electrode. The main amalgam 26*b* is provided in, for example, the thin tubes 78. The auxiliary amalgam 30*a* is attached to, for example, wells 85 that hold the filament electrodes 83.

The cap 80 has a cap body 80*a* and four cap pins 80*b*. The cap pins 80*b* project from one end of the cap body 80*a*. The cap 80 is, for example, a GY10q type designed for compact fluorescent lamps.

The cap body 80*a* is made of, for example, electrically insulating synthetic resin. It is shaped like an oblate disc, having two ends that are almost flat. It has, in one end, a pair of insertion holes 81 into which the capped ends of the straight bulbs 72 of the light-emitting tube 71 are inserted. Further, the cap body 80*a* has, in one end, too, two recesses 82 that are continuous to the insertion holes 81, respectively. The thin tubes 78 are located in these recesses 82. The recesses 82 are positioned side by side. The cap 80 and the light-emitting tube 71 are secured to each other with adhesive such as silicone resin.

In the compact fluorescent lamp 70, which has thin bulbs 72 and can yet generate a sufficient light output, the center of discharge caused in the light-emitting tube 72 when the lamp 70 is turned on is located very close to the connecting part 73. The distal ends of the straight bulbs 72 therefore lie at a long distance from the center of discharge. Hence, the temperature in the light-emitting tube 71 may be high while the compact fluorescent lamp 70 remains on. Nonetheless, the temperature in the distal ends of the straight bulbs 71 can be so low that the mercury-vapor pressure can be controlled to attain sufficient lamp efficiency. This is why the lamp 70 can use the main amalgam 26*b* that provides a relatively high mercury-vapor pressure.

In the compact fluorescent lamp 70, mercury is likely to accumulate in the distal ends of the straight bulbs 72. The mercury is hardly heated immediately after the lamp 70 is turned on. It is therefore desirable not to lower the mercury-vapor pressure too much in the light-emitting tube 71 as long as the lamp 70 remains off. In view of this, it is desirable to provide an auxiliary amalgam such as the auxiliary amalgam 30*a* made mainly of gold, silver, palladium, platinum, lead, tin, zinc or bismuth. If the auxiliary amalgam is so made, the lamp 70 can have an improved flux-startup characteristic for a long time.

As described above, the compact fluorescent lamp 70 according to the present embodiment uses the main amalgam 26*b* that provides a high mercury-vapor pressure and the auxiliary amalgam 30*a* that does not absorb mercury in the light-emitting tube 71 to an access while the lamp 70 remains off. The mercury-vapor pressure in the fluorescent lamp 70 can remain relatively high at normal temperature. This improves the flux-startup characteristic. Moreover, the flux-startup characteristic thus improved can be maintained for a long time.

Figure 26:
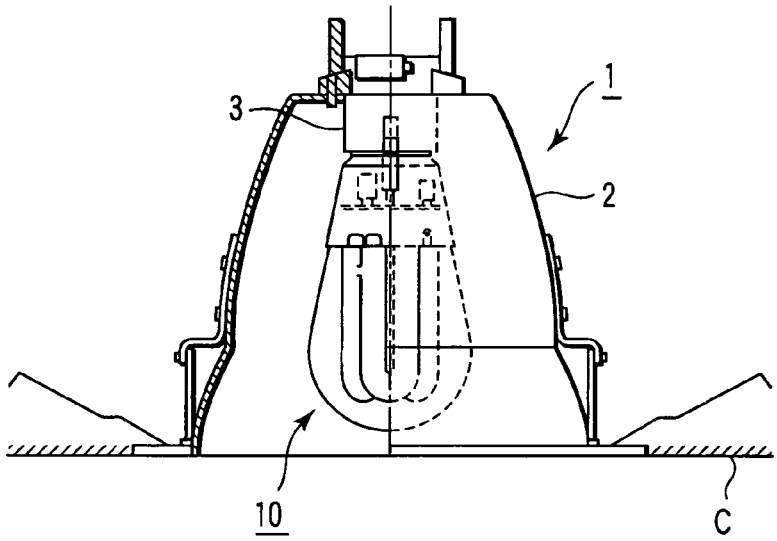
FIG. 26 is a partly sectional, side view showing a lighting apparatus that incorporates the bulb-shaped fluorescent lamp according to the first embodiment.
Figure 27:
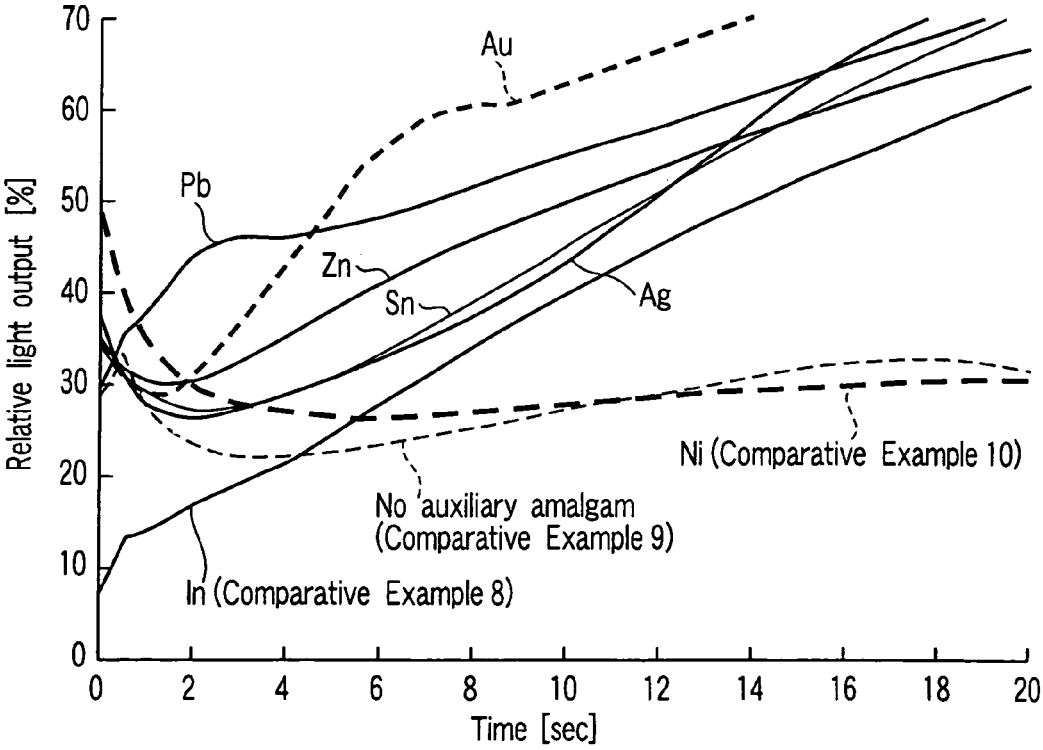
FIG. 27 is a graph representing the relationship between the flux-startup characteristics of bulb-shaped fluorescent lamps having auxiliary-amalgam metal layers of gold, silver, lead, tin and zinc, respectively, and time, and between the flux-startup characteristic of a convention bulb-shaped fluorescent lamp and time.

The bulb-shaped fluorescent lamps 10 according to the first and second embodiments can be used in, for example, the lighting apparatus 1 shown in FIG. 26. The lighting apparatus 1 is a down light fitted in a ceiling C. It comprises a main body 2, a socket 3 and a bulb-shaped fluorescent lamp 10. The socket 3 is secured to the main body 2. The lamp 10 is attached to the socket 3.

The bulb-shaped fluorescent lamp 10 configured as described above can be used in the lighting apparatus 1, in place of a bulb for general lighting use. In this case, the light emitted by the lamp 10 can be applied in a sufficient amount to the reflector provided in the main body 2 and located near the socket 3, if it is distributed in the same way as the light emitted by the bulb for general lighting use. This enables the lighting apparatus 1 to acquire such an operating characteristic as designed. Furthermore, if the lighting apparatus 1 is a table lamp that has a cloth shade through which light diffuses, the bulb-shaped fluorescent lamp 10 can distribute light almost in the same way as the bulb for general lighting use.

The main body 2 can be a new one or one already fitted in the ceiling, and can set the bulb-shaped fluorescent lamp 10 if it has a socket 3 to which the cap 42 can be detachably connected. The lighting apparatus 1 is not limited to a down light. It can have any other type of a main body 2 that can directly hold the bulb-shaped fluorescent lamp 10.

The lighting apparatus 1 may have the electrodeless, bulb-shaped fluorescent lamp 110 according to the third embodiment, in place of the bulb-shaped fluorescent lamp 10. The compact fluorescent lamp 70 according to the fourth embodiment needs to be used in lighting apparatuses different from the light apparatus 1. It finds use in, for example, a lighting apparatus that comprises a main body, a socket that can hold the cap 80, e.g., GY10q type designed for compact fluorescent lamps, and a lamp-driving device for driving the compact fluorescent lamp 70.

The metal layers 32*a* to 32*c* of the auxiliary amalgams 30*a* to 30*d*, respectively, are made mainly of gold. They are not limited to gold layers, nevertheless. Metal layers, each containing at least one element selected from the group consisting of gold, silver, palladium, platinum, lead, tin, zinc and bismuth, have common property of not absorbing mercury to an excess while the lamp remains off.

The present invention can provide a fluorescent lamp that exhibits good flux-startup characteristic for a long time. Further, the invention can provide a bulb-shaped fluorescent lamp that is similar to an incandescent lamp and exhibits good flux-startup characteristic for a long time. Still further, the invention can provide a lighting apparatus that has the fluorescent lamp or the bulb-shaped fluorescent lamp.

What is claimed is:

1. A bulb-shaped fluorescent lamp comprising:

(A) a fluorescent lamp comprising:

(A-1) a light-emitting tube, (A-2) a main amalgam contained in a thin pipe sealed at one end of the light-emitting tube so as to protrude into the light emitting tube, wherein the main amalgam provides a mercury-vapor pressure of 0.04 Pa or more at 25° C., and (A-3) an auxiliary amalgam provided in the vicinity of a pair of electrodes sealed to the light-emitting tube, wherein the auxiliary amalgam comprises:

(A-3-1) a base containing at least one element selected from the group consisting of chromium, molybdenum and tungsten, (A-3-2) a metal layer provided on the base, the metal layer consisting mainly of one element selected from the group consisting of gold, silver, palladium, platinum, lead, tin, zinc and bismuth, or consisting mainly of alloy that contains at least two elements selected from the group consisting of gold, silver, palladium, platinum, lead, tin, zinc and bismuth, and having a thickness of 0.05 μm to 5 μm, wherein crystals constituting the metal layer are porous and satisfy at least one of following three conditions: randomly selected regions of the surface of the metal layer have an arithmetic mean roughness exceeding 0.02 μm; the metal layer has a maximum roughness-height Ry that exceeds 0.3 μm; and the surface of the metal layer has a ten-point average roughness exceeding 0.2 μm, and (A-3-3) a diffusion-inhibiting layer provided between the base and the metal layer and having a thickness of 0.01 μm to 5 μm, wherein the diffusion-inhibiting layer is made mainly of one element selected from the group consisting of nickel, chromium, molybdenum and tungsten, and inhibits the diffusion of metal from the metal layer in to the base;

(B) a lamp-driving device having a substrate and electronic components mounted on the substrate and configured to output high-frequency power to the fluorescent lamp; and (C) a cover containing the lamp-driving device and having a cap at one end and a holding part at the other end, the holding part holding the fluorescent lamp.

2. The fluorescent lamp according to claim 1, wherein the base is 10 μm to 60 μm thick.

3. A lighting apparatus comprising:

a bulb shaped fluorescent lamp defined in claim 1 or 2; and a main body to which the bulb-shaped fluorescent lamp is attached.

* * * * *